US007892036B2

(12) United States Patent
Lee

(10) Patent No.: US 7,892,036 B2
(45) Date of Patent: Feb. 22, 2011

(54) ELECTRICAL WALL TAP ASSEMBLY

(75) Inventor: Dominic Kan Nam Lee, Sha Tin (CN)

(73) Assignee: Multiway Industries (HK) Ltd., Tsuen Wan (HK)

( * ) Notice: Subject to any disclaimer, the term of this patent is extended or adjusted under 35 U.S.C. 154(b) by 0 days.

(21) Appl. No.: 12/649,465

(22) Filed: Dec. 30, 2009

(65) Prior Publication Data

US 2010/0167580 A1 Jul. 1, 2010

Related U.S. Application Data

(60) Provisional application No. 61/203,904, filed on Dec. 30, 2008.

(51) Int. Cl.
*H01R 25/00* (2006.01)

(52) U.S. Cl. ..... 439/638

(58) Field of Classification Search ..... 439/638, 439/650, 651, 652, 653
See application file for complete search history.

(56) References Cited

U.S. PATENT DOCUMENTS

| | | | |
|---|---|---|---|
| 1,511,855 | A | 10/1924 | Wentz |
| 1,568,156 | A | 1/1926 | Herskovitz |
| D77,735 | S | 2/1929 | Both |
| D80,102 | S | 12/1929 | Muldoon |
| D86,613 | S | 3/1932 | Lauter |
| 1,889,695 | A | 11/1932 | Petersen |
| 1,935,771 | A | 11/1933 | Feurstein et al. |
| D109,912 | S | 5/1938 | Guild |
| 2,210,215 | A | 8/1940 | Herman |
| D126,590 | S | 4/1941 | Lewin |
| 2,267,816 | A | 12/1941 | Chirelstein |
| 2,318,484 | A | 5/1943 | Herman |
| 2,500,987 | A | 3/1950 | Harpster |
| 2,508,770 | A | 5/1950 | Oshinsky |
| D159,004 | S | 6/1950 | Russell |
| D164,338 | S | 8/1951 | Tyler |
| 2,636,096 | A | 4/1953 | Di Blasi |
| D179,081 | S | 10/1956 | Hudson |
| 2,792,561 | A | 5/1957 | Cohen |
| 3,005,179 | A | 10/1961 | Holt |

(Continued)

OTHER PUBLICATIONS

U.S. Appl. No. 12/231,508, filed Sep. 3, 2008, Lee.

(Continued)

*Primary Examiner*—Chandrika Prasad
(74) *Attorney, Agent, or Firm*—Frost Brown Todd LLC

(57) ABSTRACT

An electrical wall tap assembly comprises a central portion, a male input connector, at least one female output connector, and an electrical subassembly. In this embodiment, the electrical subassembly comprises a top cover, an upper cover, a lower cover, a bottom cover, and electric power distribution circuitry. In this version, the top cover comprises at least one attachment aperture, and the lower cover comprises at least one attachment member configured to engage the at least one attachment aperture in the top cover. In this version, the electric power distribution circuitry electrically connects the male input connector and the at least one female output connector. In an alternate embodiment, an electrical wall tap assembly comprises an electrical subassembly and an outer covering configured to encase the electrical subassembly. In another embodiment, an electrical wall tap assembly comprises a male input connector, a plurality of female output connectors, and an electrical subassembly.

20 Claims, 28 Drawing Sheets

U.S. PATENT DOCUMENTS

D194,105 S 11/1962 Stringham
D195,955 S 8/1963 Carlson
D216,262 S 12/1969 Robinson
3,509,356 A 4/1970 Peebles
3,924,914 A 12/1975 Banner
3,997,225 A 12/1976 Horwinski
4,000,405 A 12/1976 Horwinski
4,079,344 A 3/1978 Lauben et al.
4,085,996 A 4/1978 Koslo
4,118,690 A 10/1978 Paynton
D251,293 S 3/1979 Trueblood
4,191,985 A 3/1980 Phillips, Jr.
4,293,172 A 10/1981 Lingaraju
D276,225 S 11/1984 Powel
D277,370 S 1/1985 Gehr et al.
D284,758 S 7/1986 Maloney
D285,552 S 9/1986 Schwartz
D285,788 S 9/1986 Rapp et al.
D288,177 S 2/1987 Yang
4,659,161 A 4/1987 Holcomb
4,671,597 A 6/1987 Grill
D292,395 S 10/1987 Waters et al.
4,764,128 A 8/1988 Cheng
4,767,359 A 8/1988 Martell
D301,576 S 6/1989 Wang
4,856,999 A 8/1989 Flohr
4,861,286 A 8/1989 Fosnaugh
D305,641 S 1/1990 DeLuca
4,897,049 A 1/1990 Miller et al.
D307,742 S 5/1990 Serr et al.
D312,615 S 12/1990 Schwartz
D315,141 S 3/1991 Hames
D315,893 S 4/1991 Cheng
5,004,435 A 4/1991 Jammet
D318,262 S 7/1991 Neuwirth
5,030,119 A 7/1991 Lowe
5,094,630 A 3/1992 Jammet
D325,370 S 4/1992 Belcher
D325,723 S 4/1992 Gary et al.
5,122,082 A 6/1992 Lee
D329,423 S 9/1992 Luu
5,171,168 A 12/1992 Chiodo
5,207,594 A 5/1993 Olson
5,211,584 A 5/1993 Lee
5,232,381 A 8/1993 Yu
5,236,371 A 8/1993 Matthis
5,269,695 A 12/1993 Opel
D347,593 S 6/1994 Davis et al.
D347,594 S 6/1994 Davis et al.
D350,936 S 9/1994 Rossman et al.
D350,938 S 9/1994 Rossman et al.
5,383,799 A 1/1995 Fladung
D357,460 S 4/1995 Lovett
D361,315 S 8/1995 Wedell et al.
5,443,400 A 8/1995 Brown et al.
D364,379 S 11/1995 Pogue et al.
D370,459 S 6/1996 Boesel et al.
D371,341 S 7/1996 Hung et al.
D372,702 S 8/1996 Sanner
5,562,488 A 10/1996 Neiser et al.
D375,292 S 11/1996 D'Amato
D376,129 S 12/1996 Muller et al.
D379,966 S 6/1997 Gallagher
5,645,147 A 7/1997 Kovacik et al.
D382,658 S 8/1997 Yu
5,660,554 A 8/1997 Mead
5,666,053 A 9/1997 Suzuki et al.
5,700,150 A 12/1997 Morin
D397,086 S 8/1998 Lin
5,816,860 A 10/1998 Blanche
D401,555 S 11/1998 Tam
D406,562 S 3/1999 Al-Sabah
5,888,105 A 3/1999 Brown et al.
D408,355 S 4/1999 Welsh et al.
D411,981 S 7/1999 Jeon-Chapman et al.
D415,105 S * 10/1999 Lee ..... D13/139.1
D425,638 S 5/2000 Yuen
D436,345 S 1/2001 Lentine
D440,203 S 4/2001 Ewing et al.
D442,550 S 5/2001 Tong et al.
D442,916 S 5/2001 Tong et al.
D443,589 S 6/2001 Tong et al.
D446,187 S 8/2001 Lam et al.
D446,502 S 8/2001 Wen
D448,730 S * 10/2001 Lee ..... D13/137.4
D462,056 S 8/2002 Chung
D467,873 S 12/2002 Yu
D468,848 S 1/2003 Schenck
D469,062 S 1/2003 Nieto et al.
D481,357 S 10/2003 Stekelenburg
D483,331 S 12/2003 Adachi et al.
D483,723 S 12/2003 Adachi et al.
D486,126 S 2/2004 Aromin
6,709,297 B2 * 3/2004 Lee ..... 439/638
D492,253 S 6/2004 Lee
D492,254 S 6/2004 Nakashima et al.
D493,426 S 7/2004 Strayer
D495,657 S * 9/2004 Lee ..... D13/137.2
6,929,514 B1 8/2005 Chuang
6,942,079 B2 * 9/2005 Chang ..... 191/12.4
D512,963 S 12/2005 Lee
D514,067 S 1/2006 Lee
D540,257 S 4/2007 Ivanova et al.
D547,271 S 7/2007 Ng
D547,272 S 7/2007 Ng
D549,650 S 8/2007 Russell et al.
D559,184 S 1/2008 Russell et al.
D562,240 S 2/2008 Lee
7,371,121 B1 * 5/2008 Lee ..... 439/650
7,371,122 B2 5/2008 Ivanova et al.
7,520,783 B2 4/2009 Chou et al.
D596,571 S 7/2009 Green
D599,290 S 9/2009 Lee
2009/0053307 A1 2/2009 Longo et al.

OTHER PUBLICATIONS

U.S. Appl. No. 12/551,913, filed Sep. 1, 2009, Lee.
U.S. Appl. No. 29/313,368, filed Dec. 30, 2008, Lee.
U.S. Appl. No. 29/345,388, filed Oct. 15, 2009, Shi.
U.S. Appl. No. 29/345,394, filed Oct. 15, 2009, Shi.
U.S. Appl. No. 29/345,398, filed Oct. 15, 2009, Shi.

* cited by examiner

ELECTRICAL WALL TAP ASSEMBLY

PRIORITY

This application claims priority to U.S. Provisional Patent Application Ser. No. 61/203,904, filed Dec. 30, 2008, entitled "Three Way Electrical Wall Tap With Light Indicator" the disclosure of which is incorporated by reference herein.

BACKGROUND

Embodiments of the present invention relate to an electrical wall tap comprising a plurality of individual female electrical outlets. Electrical wall taps comprising more than one female electrical outlet may allow for multiple devices to be plugged into a single electrical wall outlet. Each female electrical outlet may be configured to receive a male electrical plug member. Specifically, each electrical outlet may comprise a plurality of openings, wherein a first opening may be configured to receive an active spade electrode, a second opening may be configured to receive a common spade electrode, and a third opening may be configured to receive a ground electrode. It may be advantageous to have a wall tap that indicates when current is flowing through the wall tap.

While a variety of electrical wall taps have been made and used, it is believed that no one prior to the inventor has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
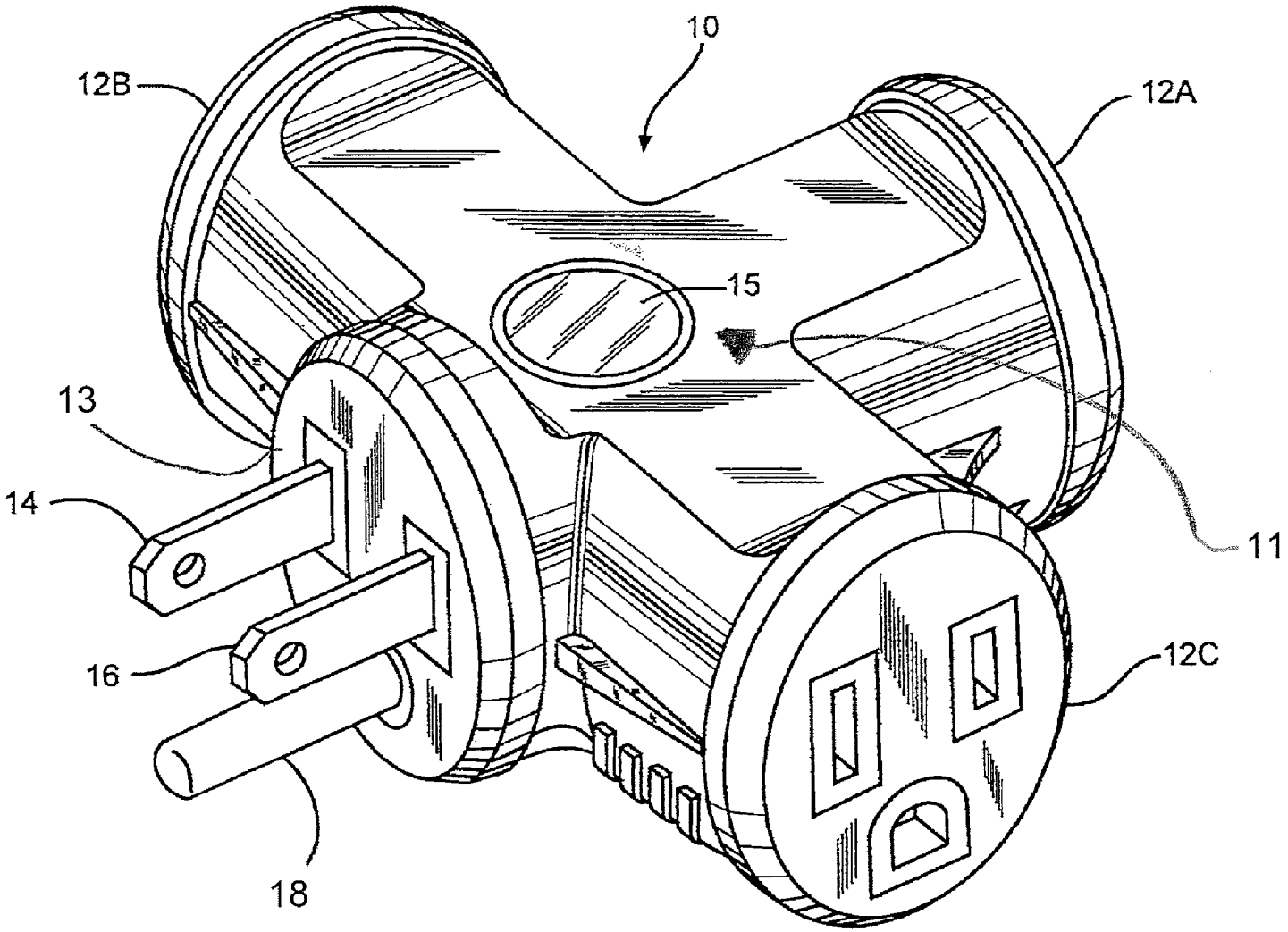
FIG. 1 depicts a perspective view of an exemplary wall tap.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 illustrates a wall tap 10 that comprises a central portion 11, three female output connectors 12*a*, 12*b*, 12*c* and a male input connector 13. As shown, each of female output connectors 12*a*, 12*b*, 12*c* and male input connector 13 are arranged around central portion 11. Of course, the number and arrangement of the female output connectors and the male input connector may be varied depending on the intended application(s) for a particular embodiment. In this example, male input connector 13 comprises an active electrical spade connector 14, a common electrical spade connector 16, and a grounding pin 18. Each of the female output connectors 12*a*, 12*b*, 12*c* may be configured to receive a corresponding male input connector of an electrical cord for an electrical device, an electrical extension cord or any other suitable item. Each female output connector 12*a*, 12*b*, 12*c* may be electrically connected to the male input connector 13 via electrical subassembly 100 described in more detail below. More specifically, the power distribution circuitry of electrical subassembly 100, described in more detail below, may be configured to electrically connect each female output connector 12*a*, 12*b*, 12*c* to the male input connector 13.

In the illustrated version, central portion 11 comprises a lens 15. Lens 15 may comprise a transparent or translucent material such that an illuminated light within wall tap 10 is visible. Lens 15 may be flat, convex, concave, or have any other shape suitable to provide any desired characteristics to light passing through lens 15. The light, described in more detail below, may be configured to be illuminated when wall tap 10 is electrically activated by plugging wall tap 10 into a suitable electrical outlet.

FIGS. 2-28 illustrate details of an internal, electrical subassembly 100 of the wall tap 10 illustrated in FIG. 1 and described above. Subassembly 100 once completed may be fully encapsulated by a molded, unitary, elastomeric covering thereby producing the final wall tap configuration as illustrated in FIG. 1. Of course, any suitable material or type of covering may be used.

Figure 2:
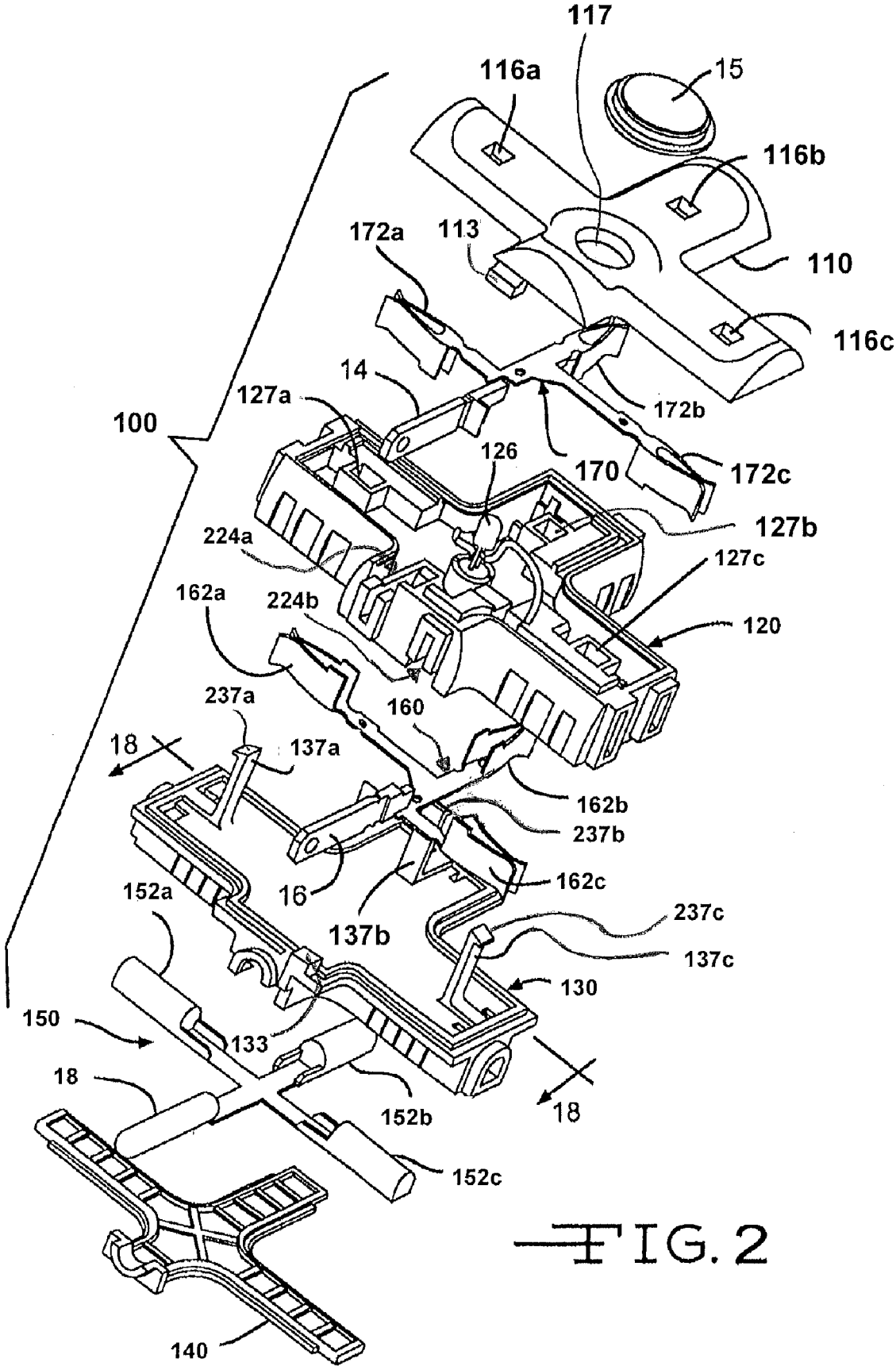
FIG. 2 depicts an exploded, assembly view of an exemplary electrical subassembly encapsulated within wall tap of FIG. 1.
Figure 3:
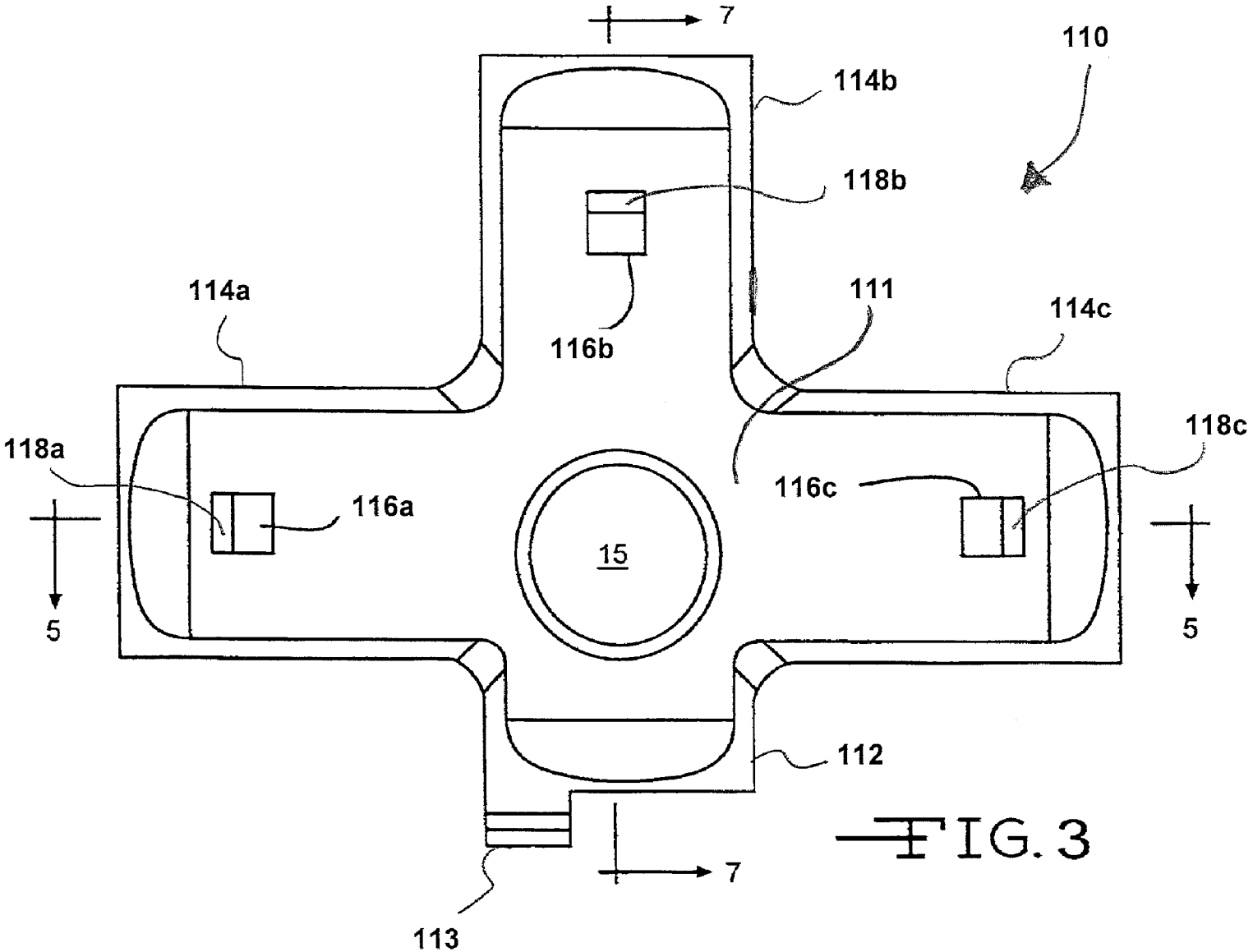
FIG. 3 depicts a top plan view of an exemplary top cover of the electrical subassembly of FIG. 2.
Figure 4:
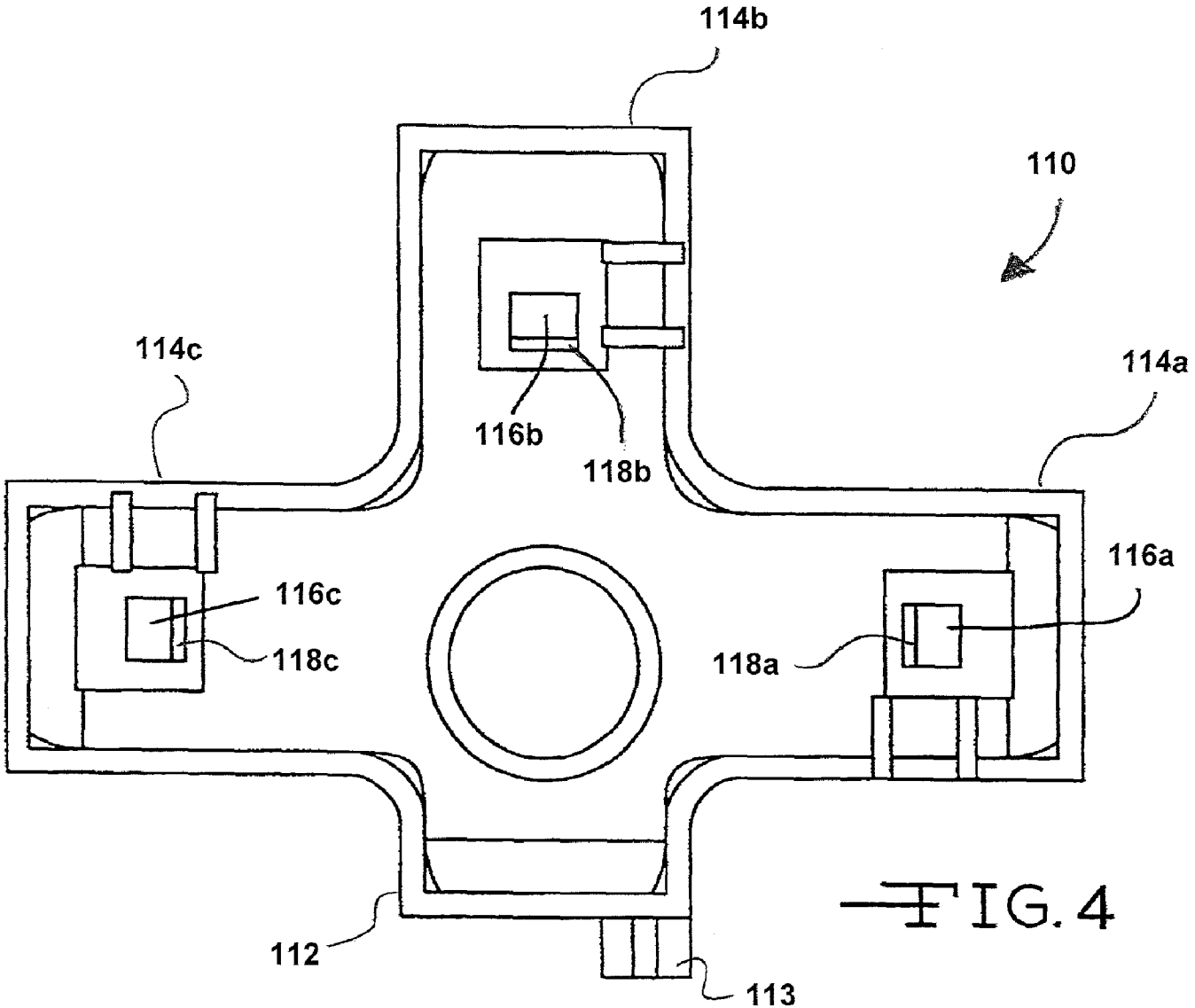
FIG. 4 depicts a bottom plan view of the top cover of FIG. 3.
Figure 5:
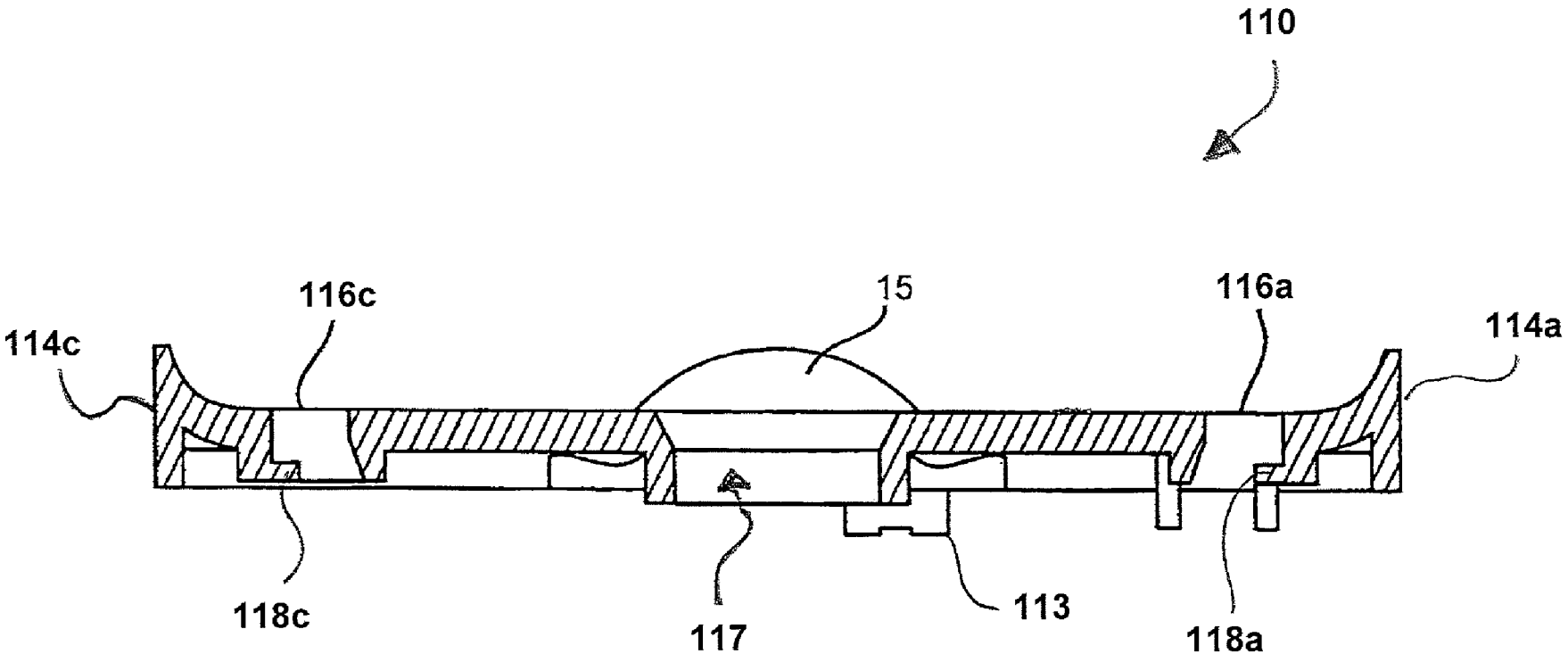
FIG. 5 depicts a cross-sectional view of the top cover of FIG. 3 taken along lines 5-5 in FIG. 3.
Figure 6:
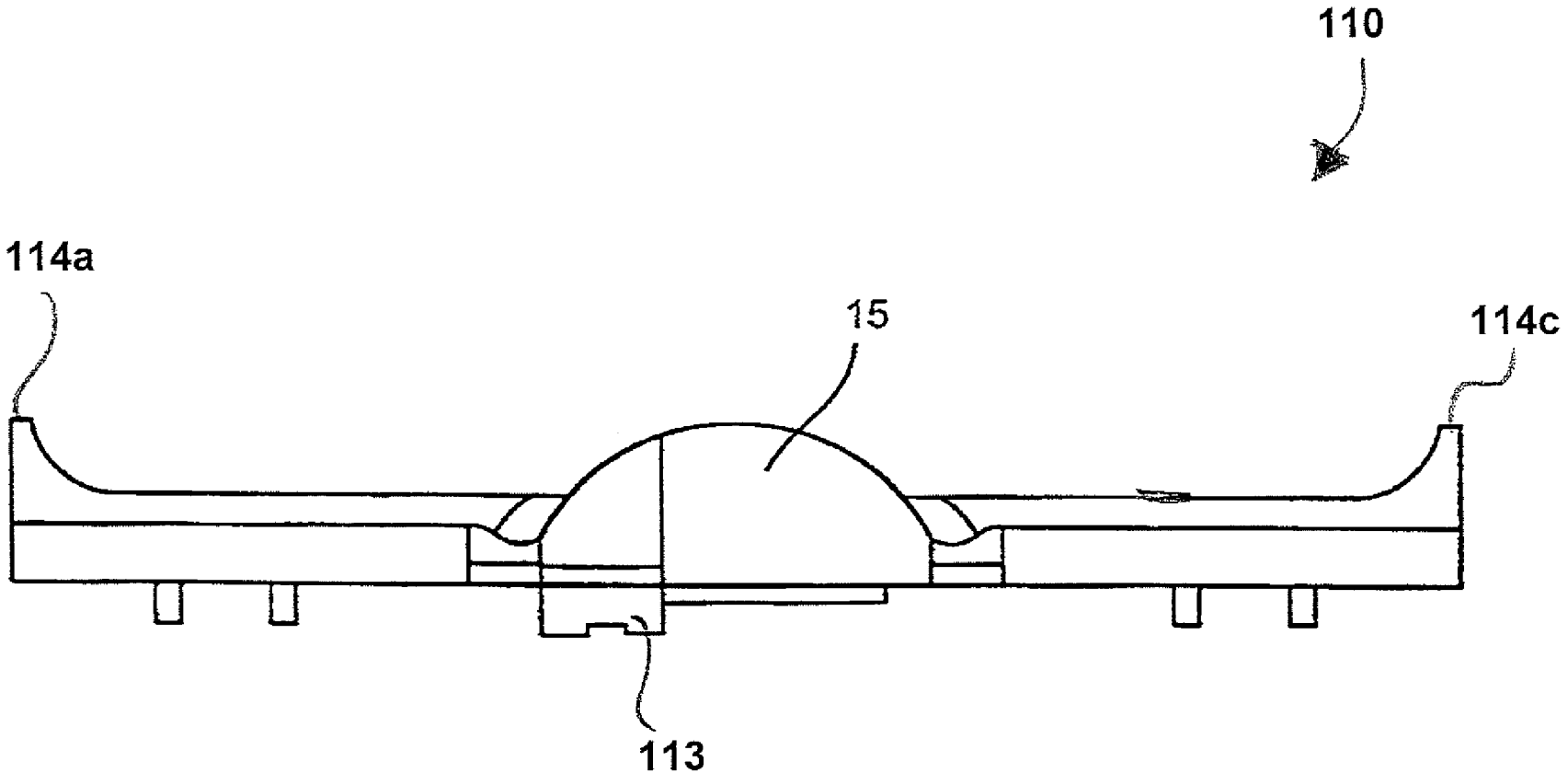
FIG. 6 depicts a front elevational view of the top cover of FIG. 3.
Figure 7:
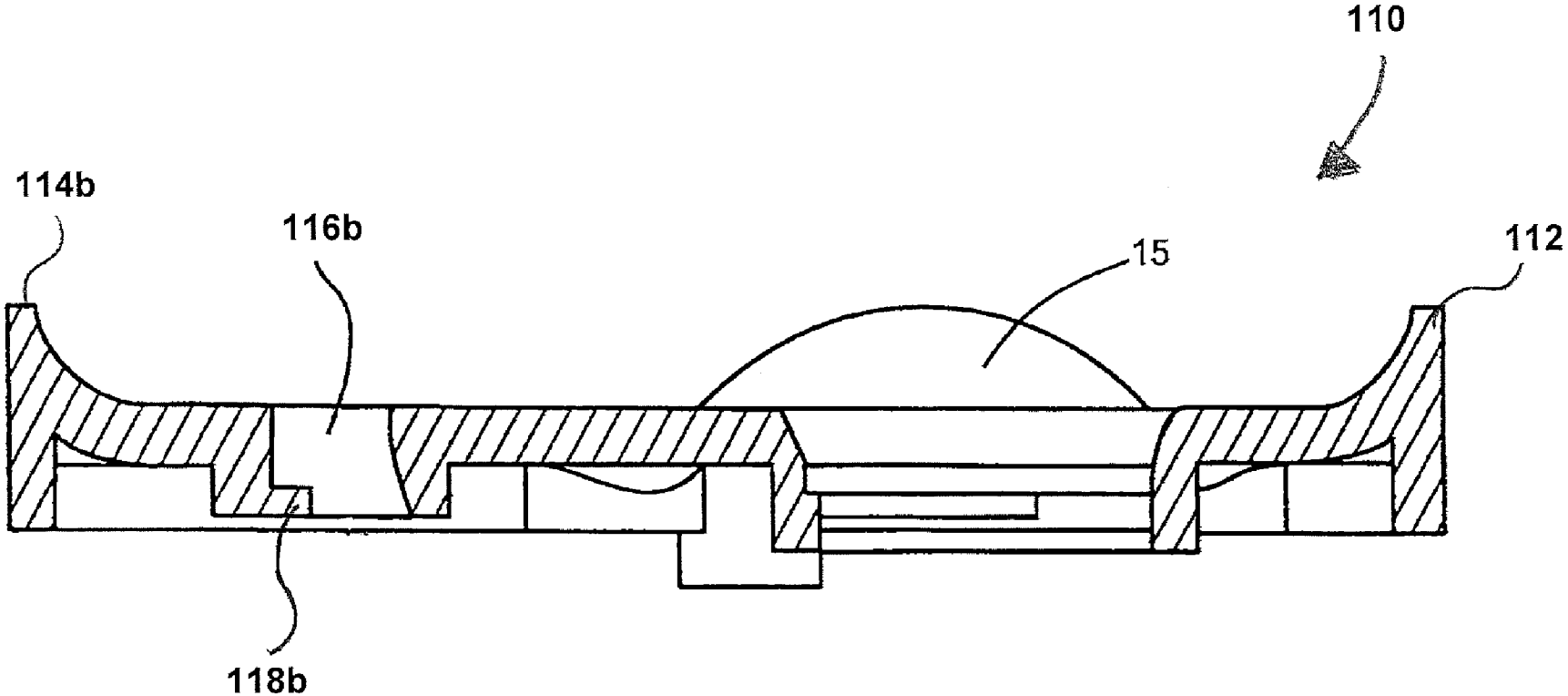
FIG. 7 depicts a cross-sectional view of the top cover of FIG. 3 taken along line 7-7 in FIG. 3.

Referring to FIG. 2, subassembly 100 comprises a top cover 110, aN upper cover 120, a lower cover 130, and a bottom cover 140. In this version, top cover 110 is attached to upper cover 120, while lower cover 130 is positioned between upper cover 110 and bottom cover 140. The outer contour of each of the components is configured to correspond to the other components and ultimately to allow the top cover 110, upper cover 120, lower cover 130 and bottom cover 140 to fit securely together to form subassembly 100. The components of subassembly 100 may be configured to provide a snap fit assembly between the components, or, alternatively one or more of the top cover 110, upper cover 120, lower cover 130, and bottom cover 140 may be assembled using a suitable adhesive, electron beam welding or any other method or device suitable for a particular application of the subassembly and/or wall tap.

Figure 8:
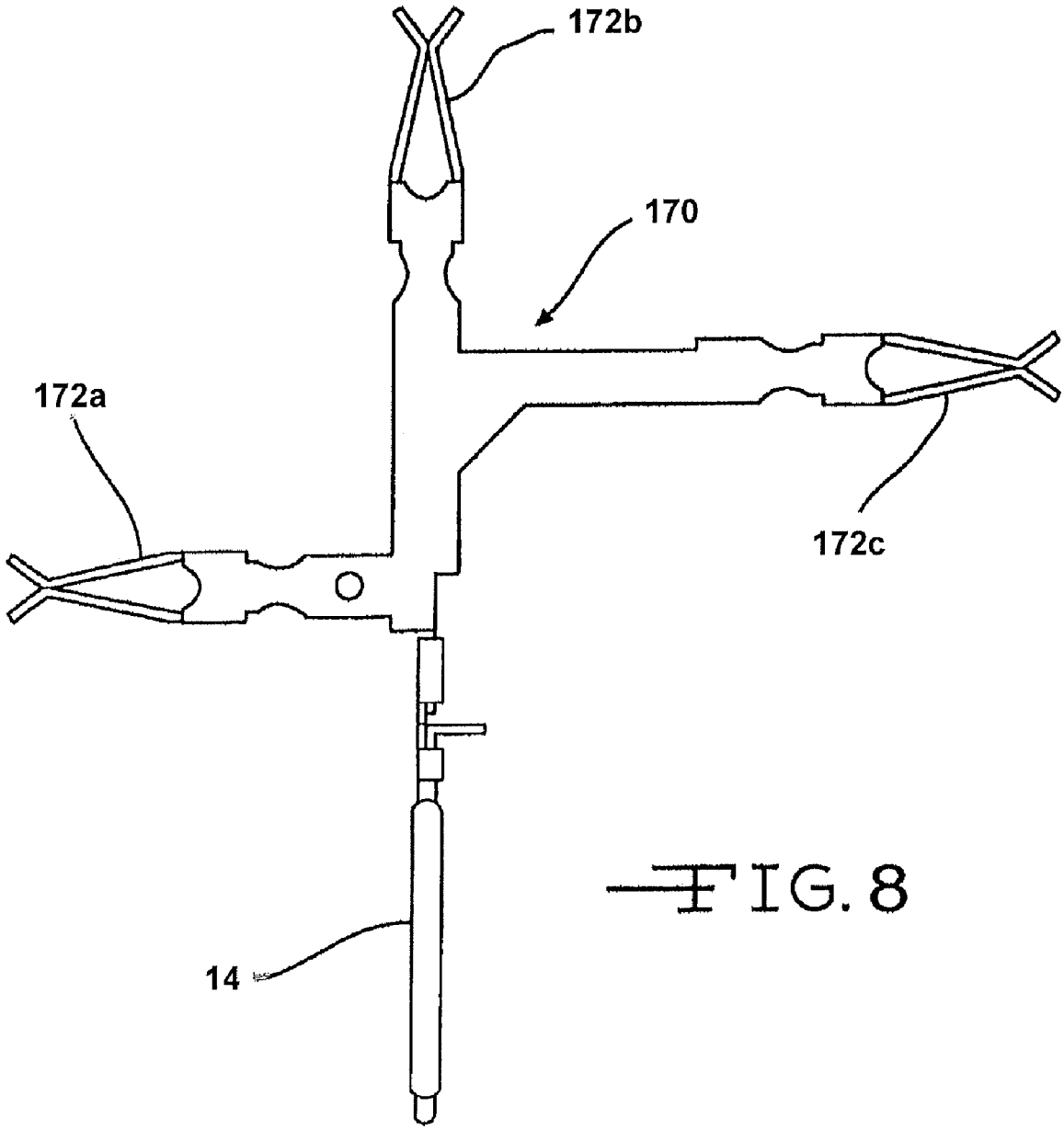
FIG. 8 depicts a top plan view of an exemplary active electrode assembly of the electrical subassembly of FIG. 2.
Figure 9:
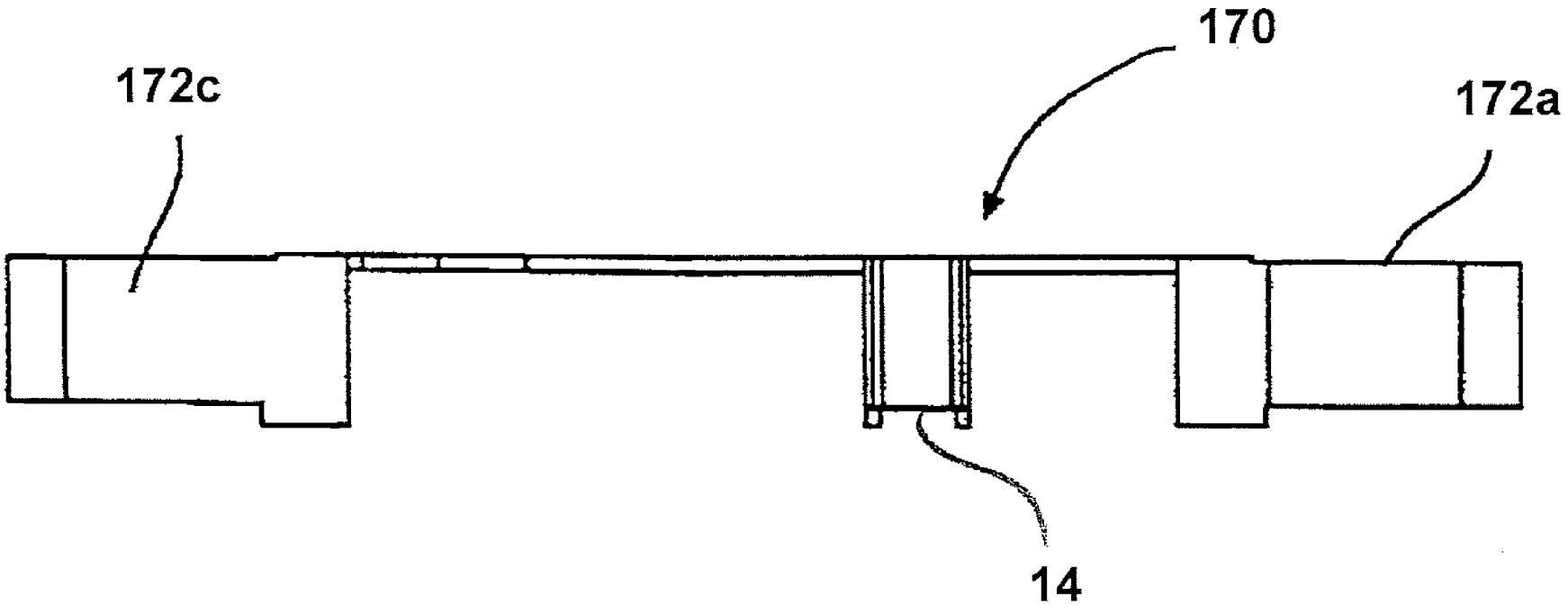
FIG. 9 depicts a front elevational view of the active electrode assembly of FIG. 8.

As shown in FIG. 2, the electric power distribution circuitry is positioned among the components of subassembly 100 and comprises a ground electrode assembly 150, a common electrode assembly 160, and an active, or hot, electrode assembly 170. As shown in FIG. 2, active electrode assembly 170 is positioned within upper surface 129*a* of upper cover 120 and covered by top cover 110. Active electrode assembly 170 may comprise brass, flat fabricated brass or copper busbars, braided copper strands, or any other material suitable for the intended application(s) of a particular embodiment. As illustrated in FIGS. 2 and 8-9 active electrode assembly 170 comprises active spade connector 14 and a plurality of active spade electrodes 172*a*, 172*b*, 172*c*. Each active spade electrode 172*a*, 172*b*, 172*c* may be configured to receive and engage an active spade connector of a male electrical plug (not shown) inserted into a female output connector 12*a*, 12*b*, 12*c* of wall tap 10. In this version, active electrode assembly 170 is shaped and configured to correspond to the other components of subassembly 100. As with the other components, other suitable numbers and arrangements of electrodes and connectors may be used.

Figure 10:
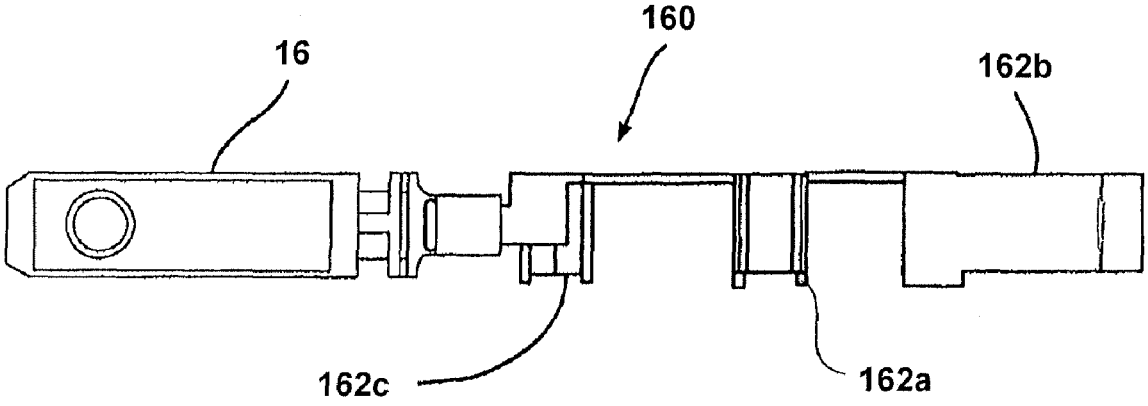
FIG. 10 depicts a side elevational view of an exemplary common spade electrode assembly of the electrical subassembly of FIG. 2.
Figure 11:
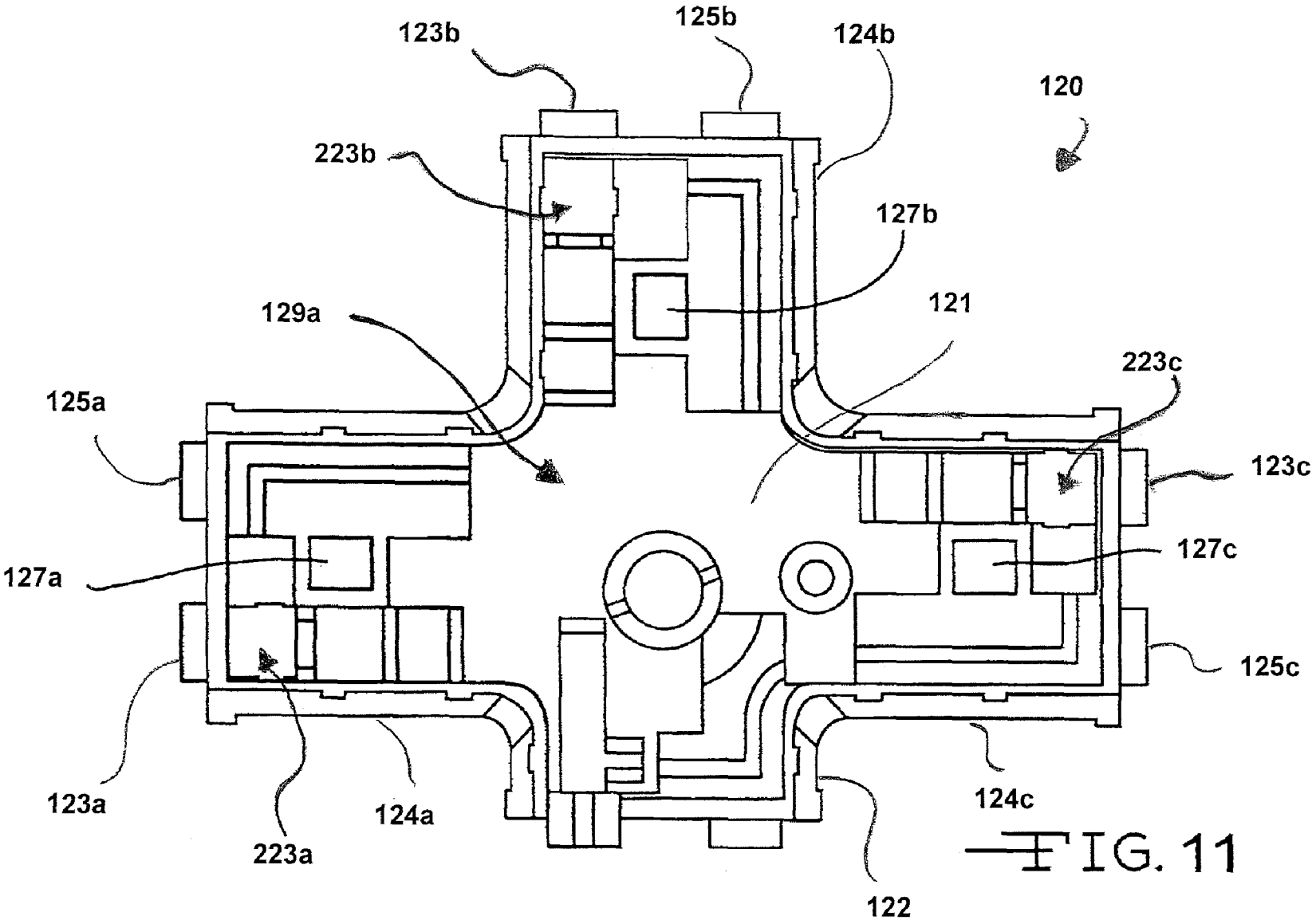
FIG. 11 depicts a top plan view of an exemplary upper cover of the electrical subassembly of FIG. 2.
Figure 12:
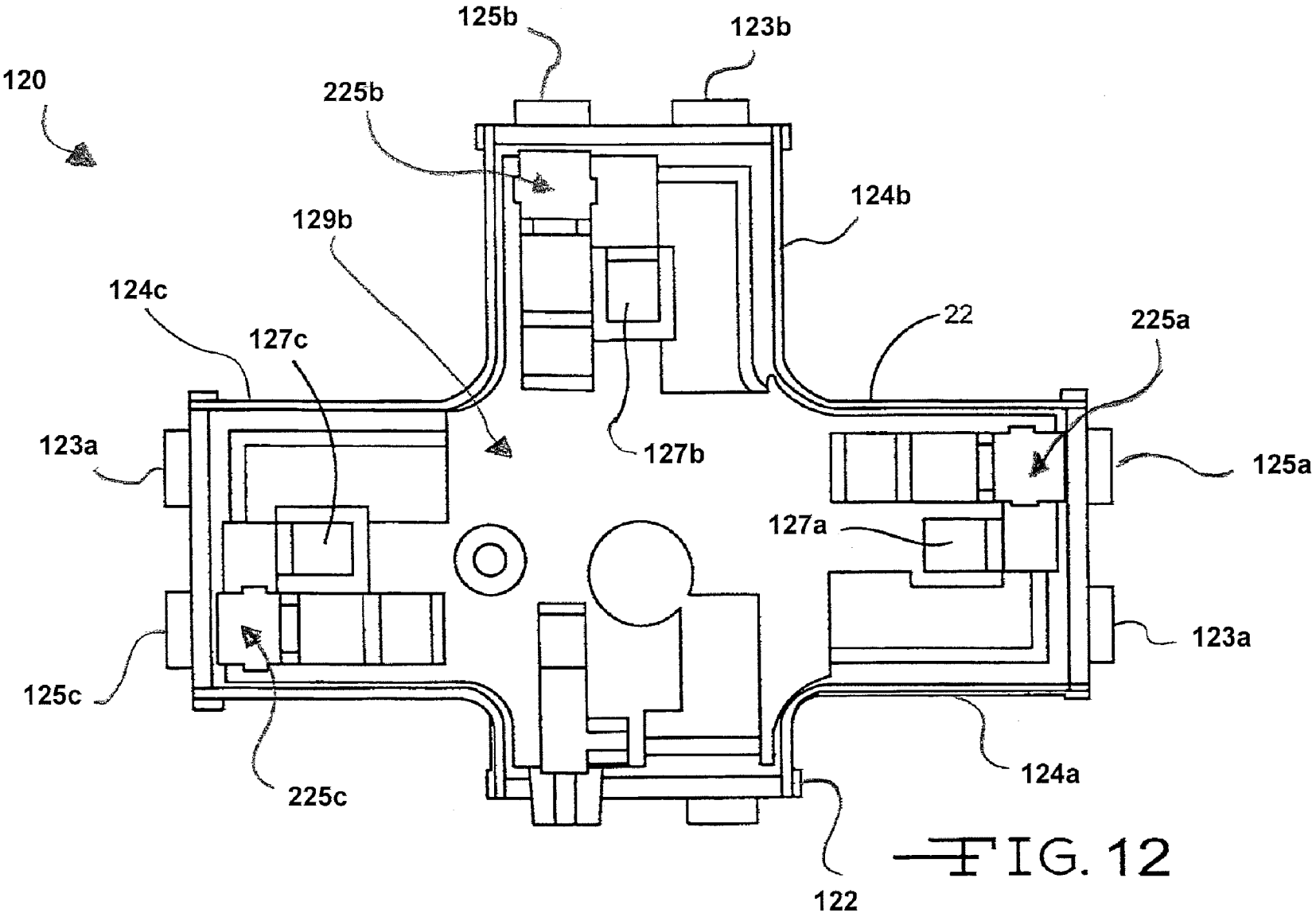
FIG. 12 depicts a bottom plan view of the upper cover of FIG. 11.
Figure 13:
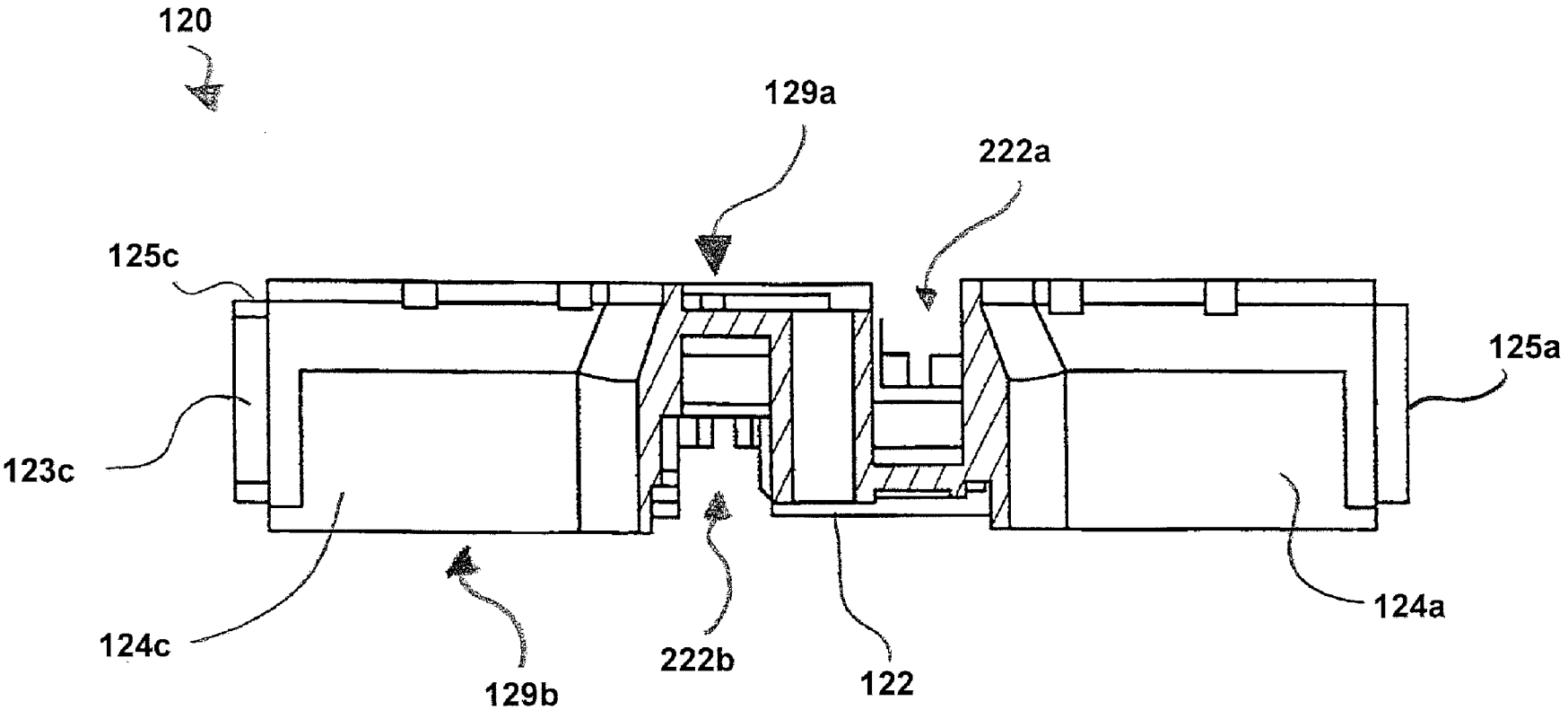
FIG. 13 depicts a rear elevational view of the upper cover of FIG. 11 with a partial cross-sectional view in the central portion of the upper cover.
Figure 14:
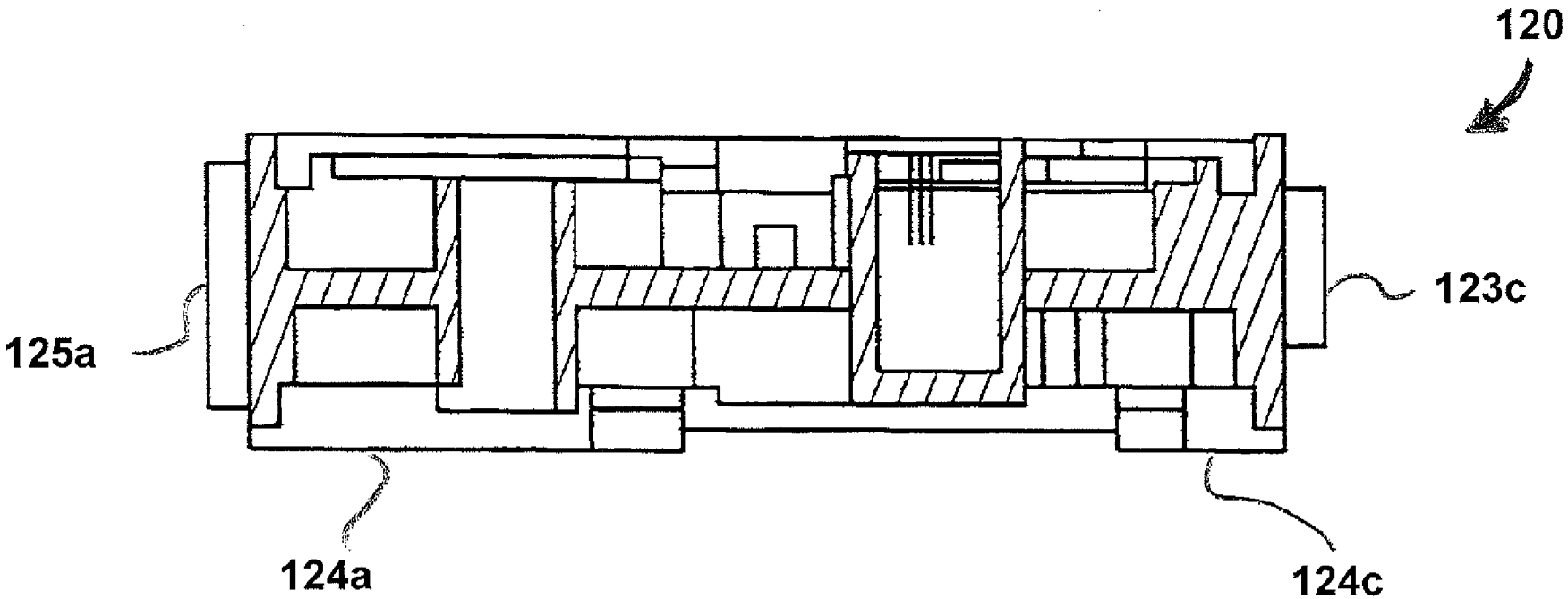
FIG. 14 depicts a cross-sectional view of the upper cover of FIG. 11.
Figure 15:
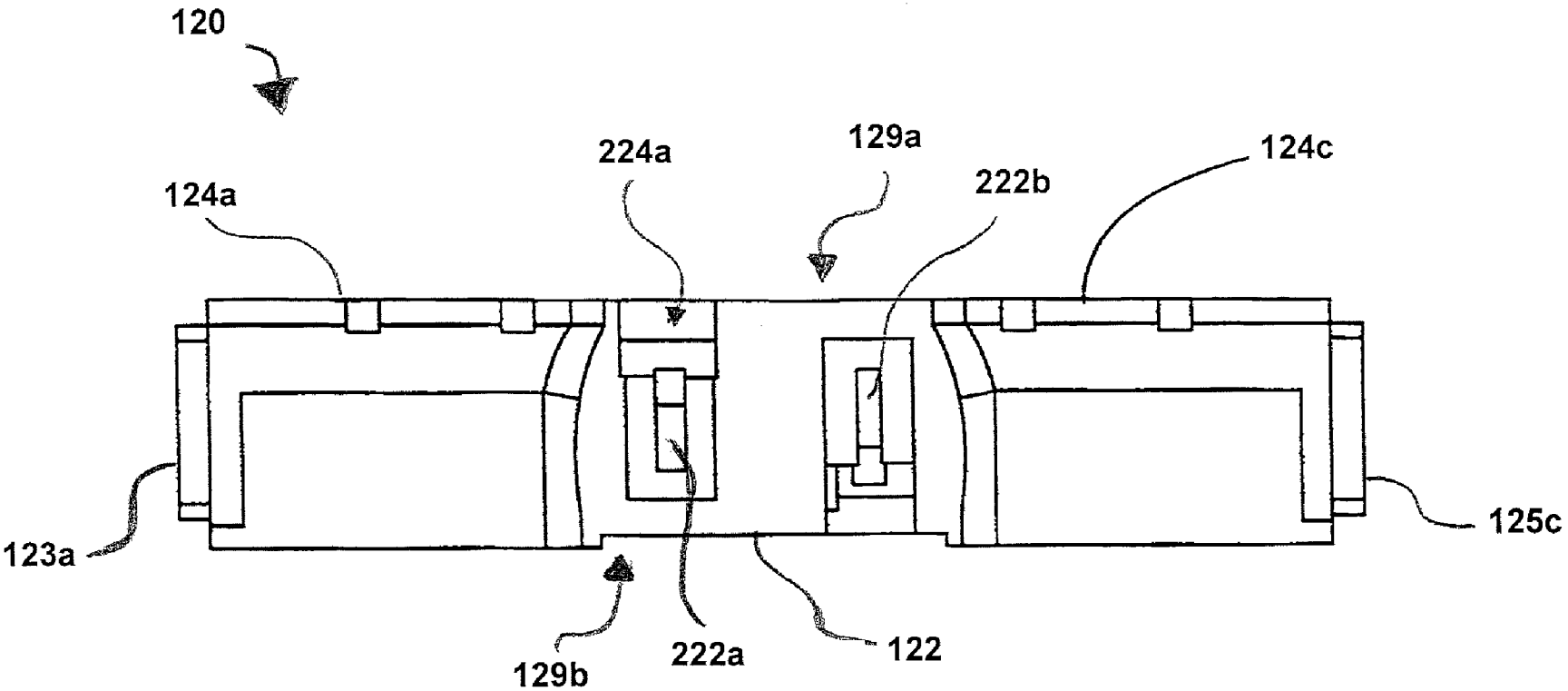
FIG. 15 depicts a side elevational view of the upper cover of FIG. 11.
Figure 16:
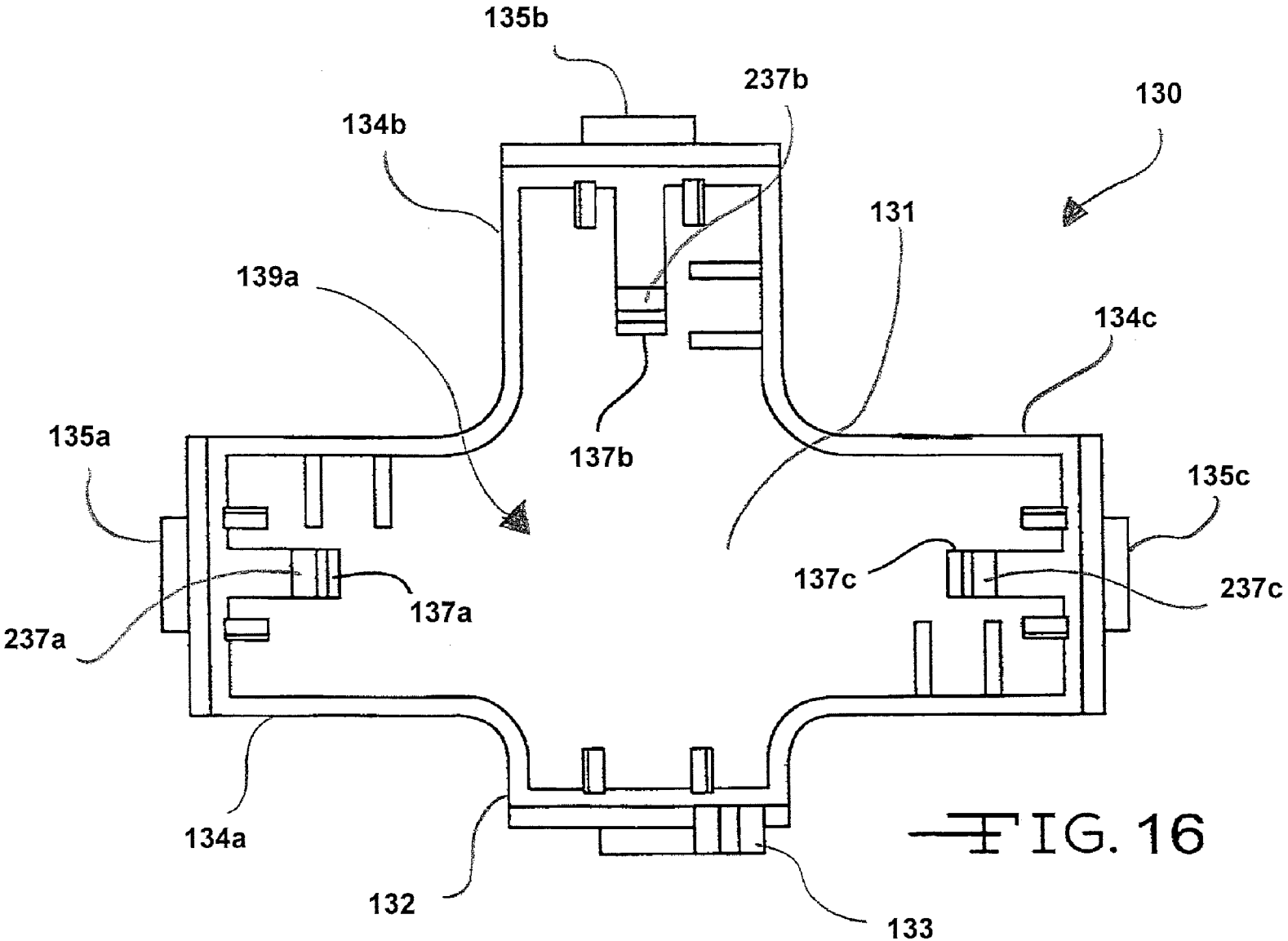
FIG. 16 depicts a top plan view of an exemplary lower cover of the electrical subassembly of FIG. 2.
Figure 17:
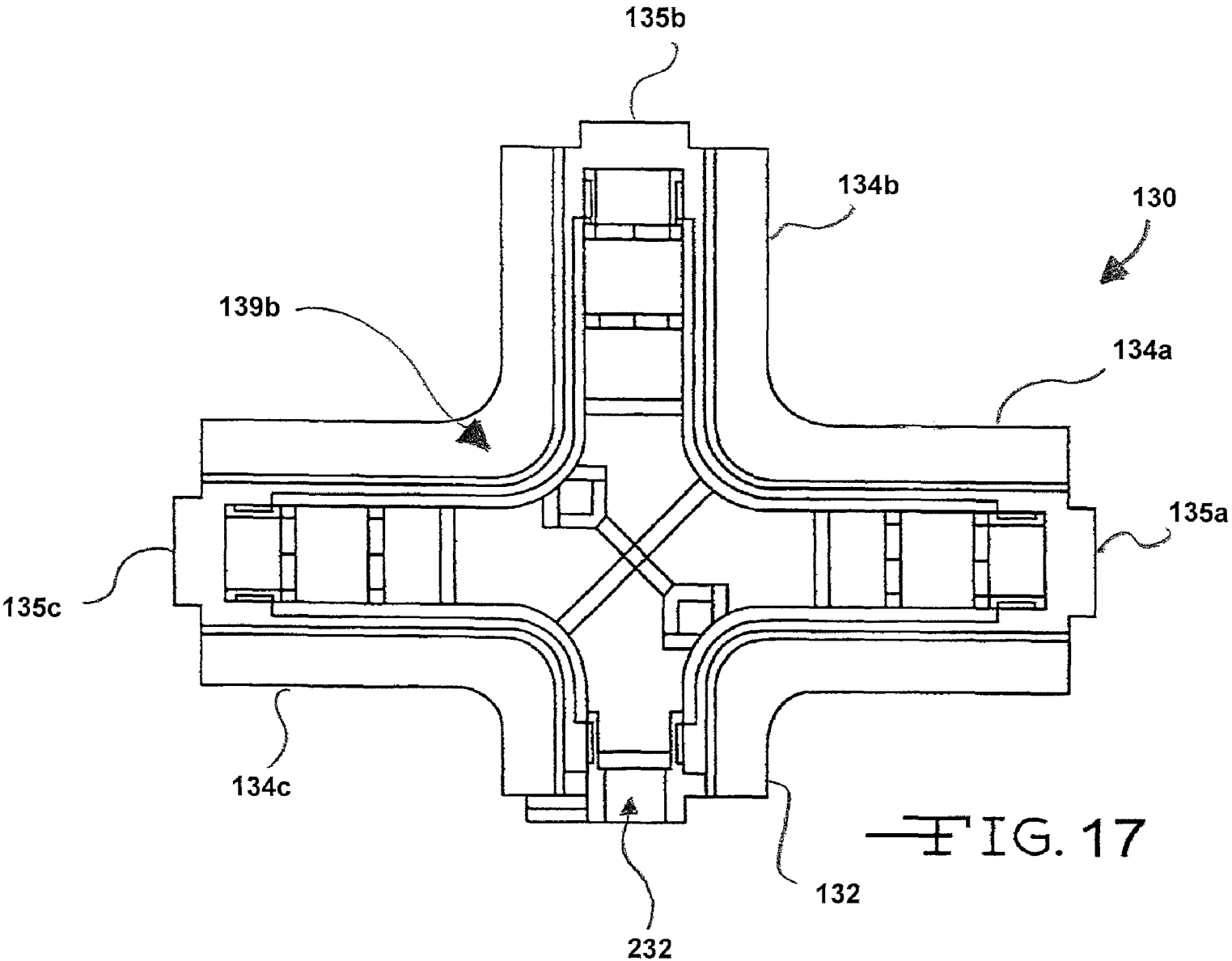
FIG. 17 depicts a bottom plan view of the lower cover of FIG. 16.
Figure 18:
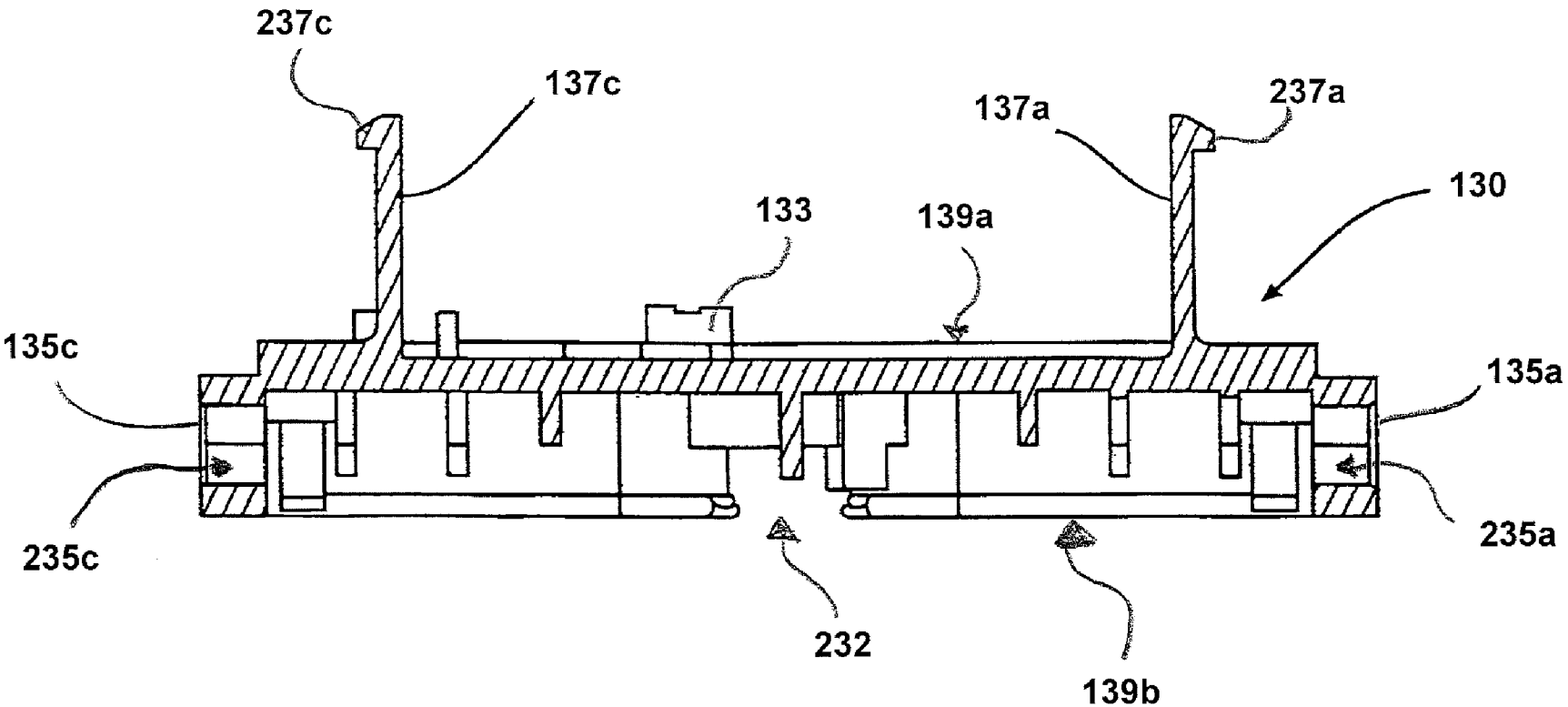
FIG. 18 depicts cross-sectional, rear view of the lower cover of FIG. 16 taken along line 18-18 in FIG. 2.
Figure 19:
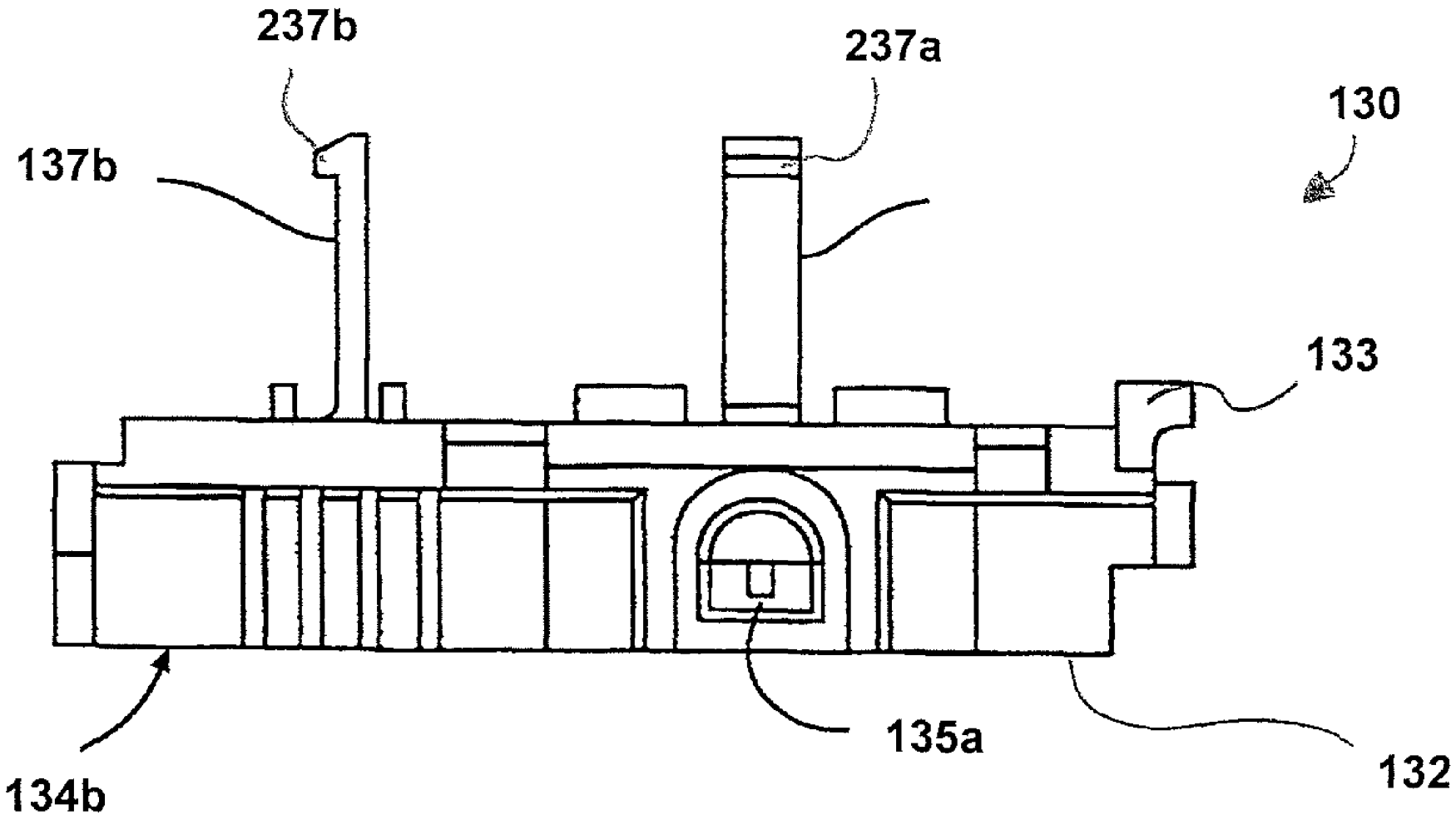
FIG. 19 depicts a side elevational view of the lower cover of FIG. 16.
Figure 20:
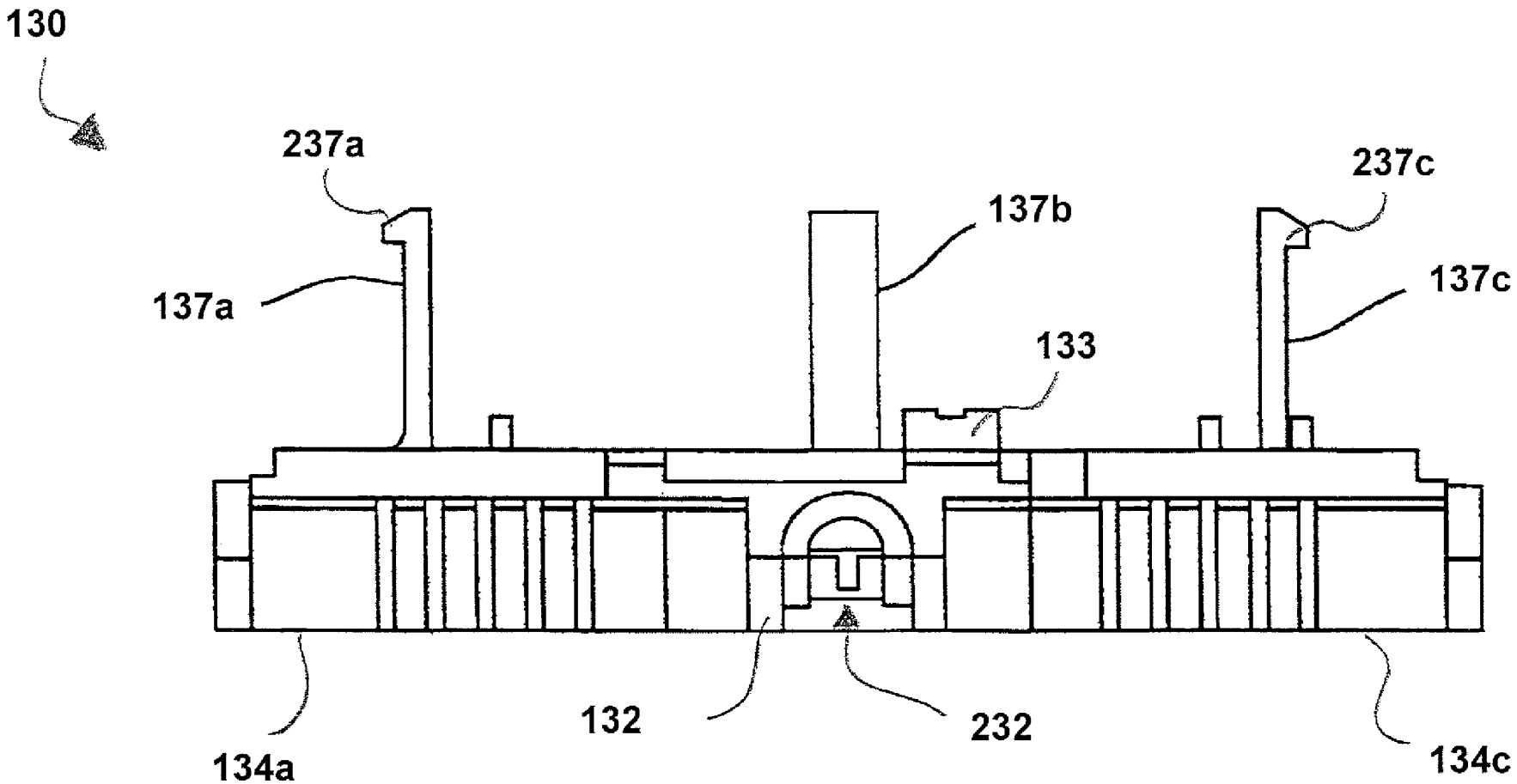
FIG. 20 depicts a front elevational view of the lower cover of FIG. 16.
Figure 21:
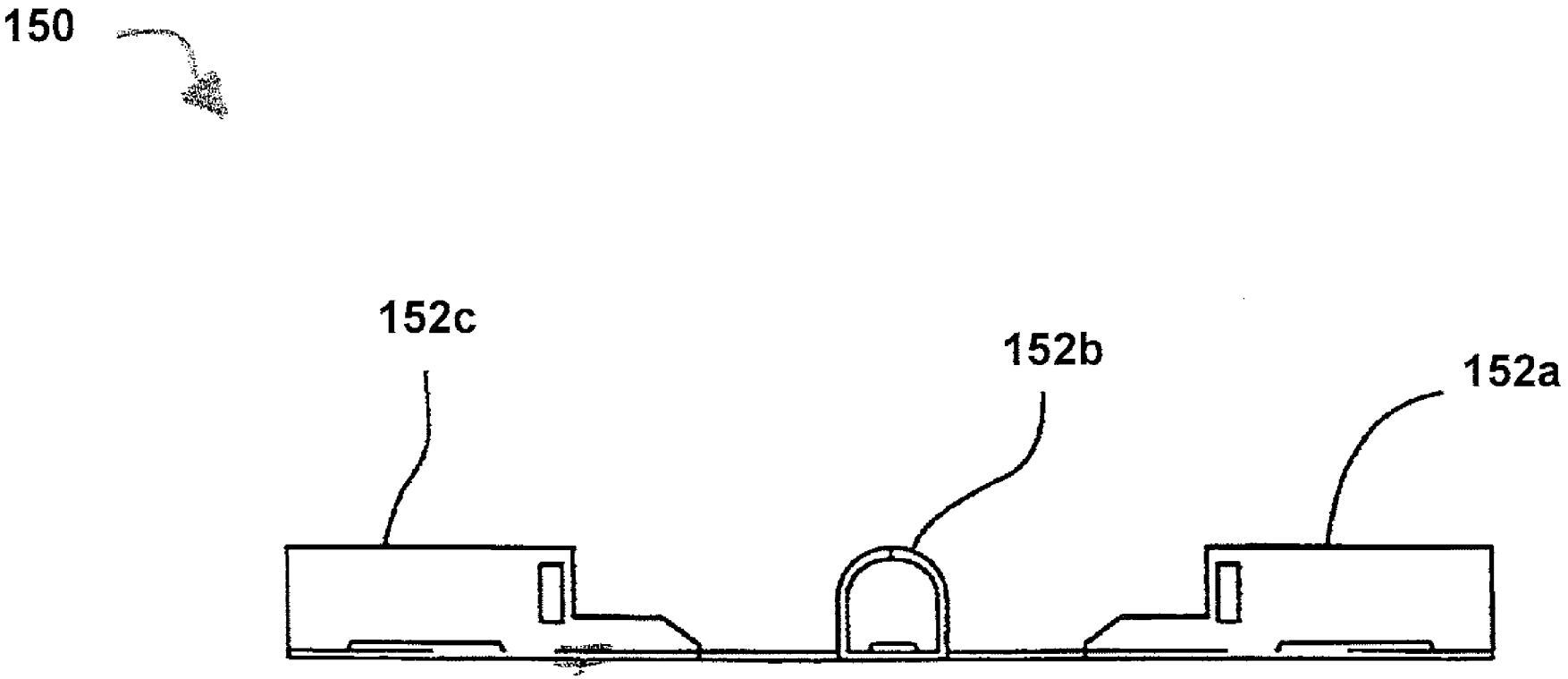
FIG. 21 depicts rear elevational view of an exemplary ground electrode assembly of the electrical subassembly of FIG. 2.
Figure 22:
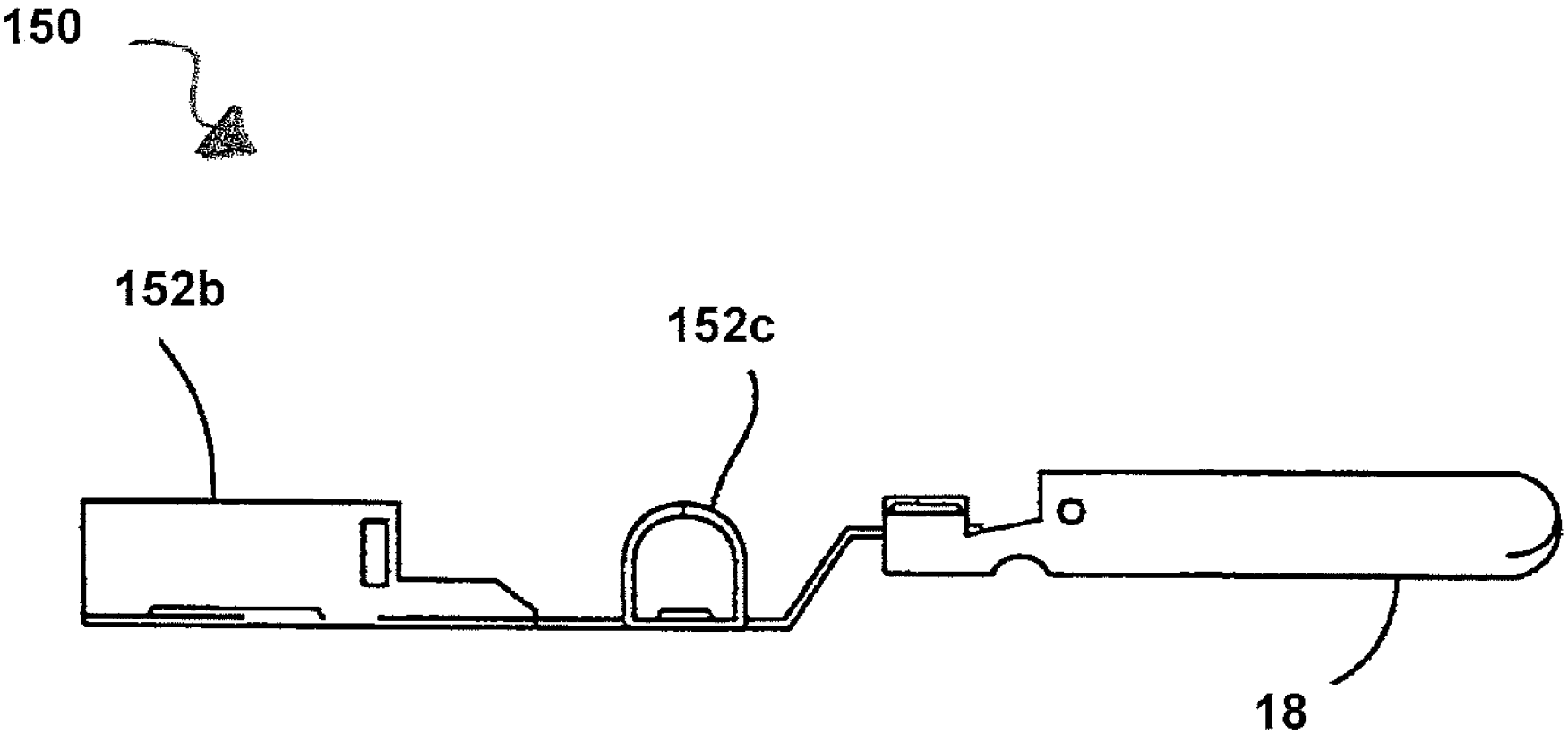
FIG. 22 depicts a side elevational view of the ground electrode assembly of FIG. 21.
Figure 23:
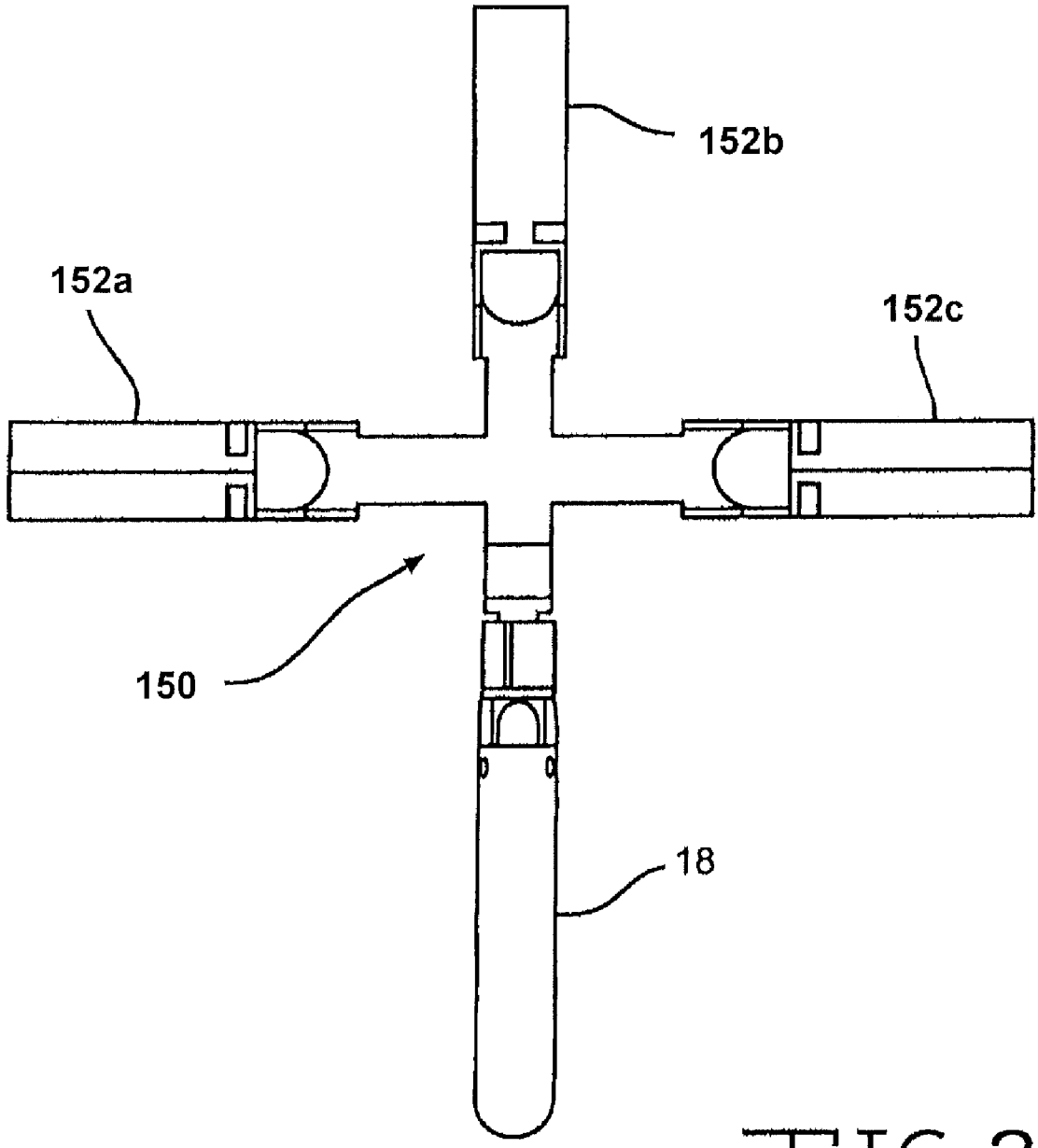
FIG. 23 depicts a top plan view of the ground electrode assembly of FIG. 21.
Figure 24:
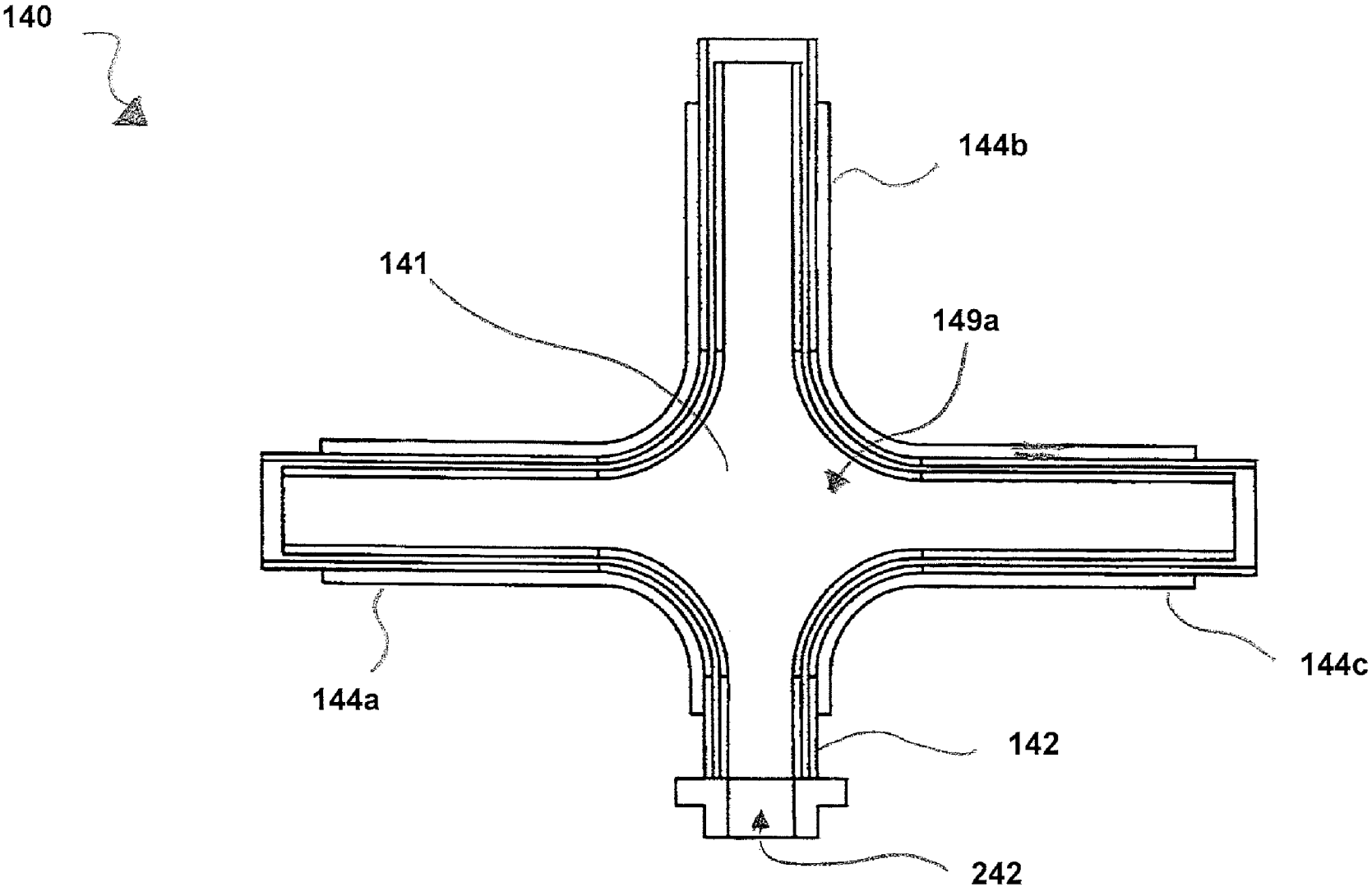
FIG. 24 depicts a top plan view of an exemplary bottom cover of the electrical subassembly of FIG. 2.
Figure 25:
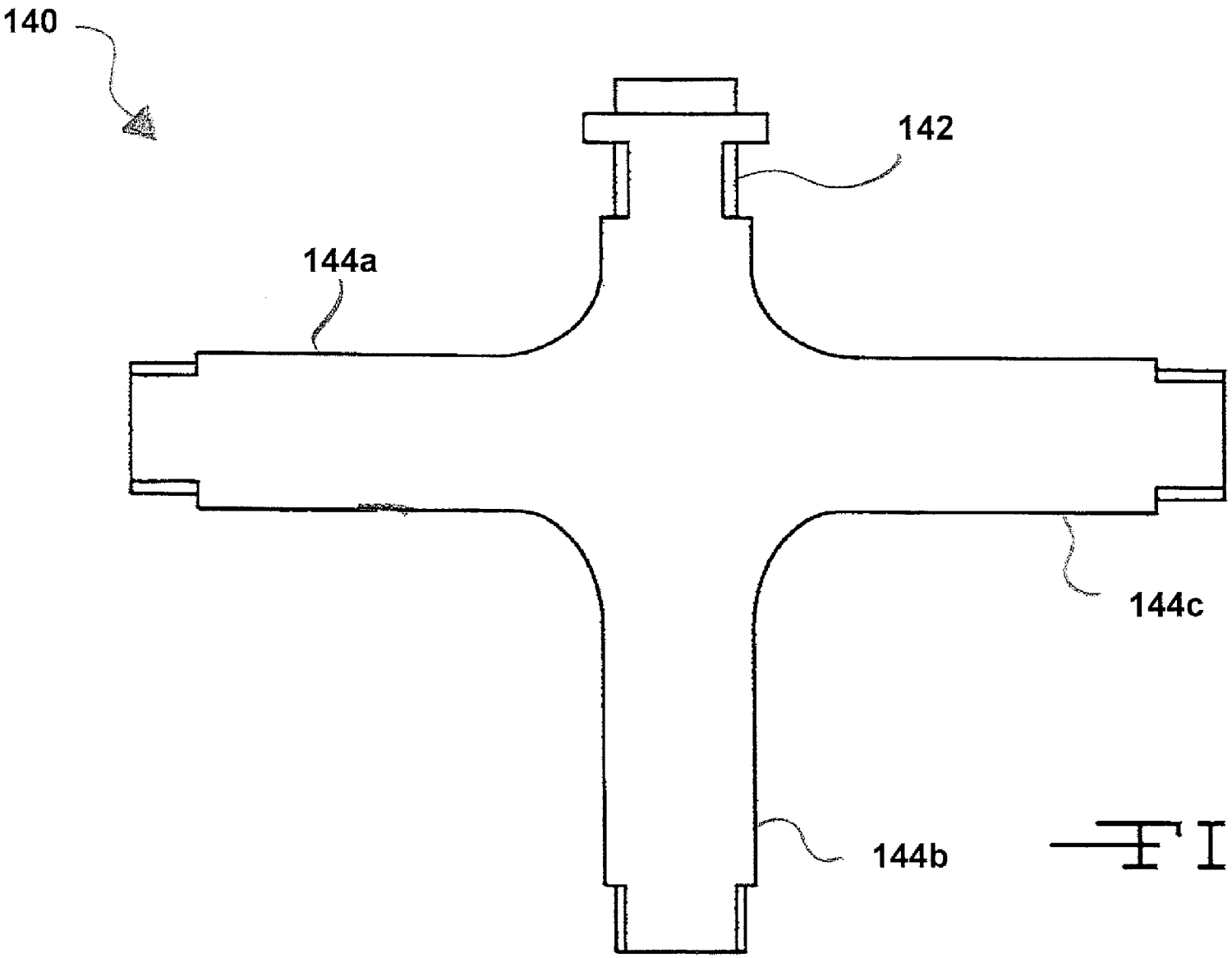
FIG. 25 depicts a bottom plan view of the bottom cover of FIG. 24.
Figure 26:
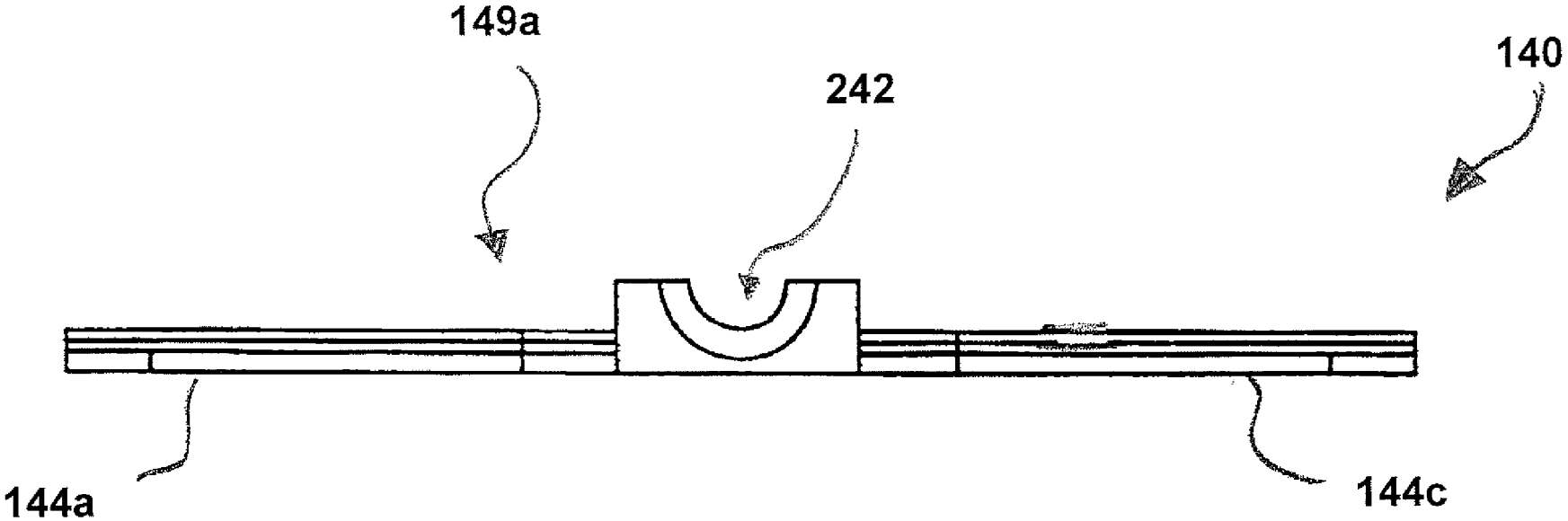
FIG. 26 depicts a front elevational view of the bottom cover of FIG. 24.
Figure 27:
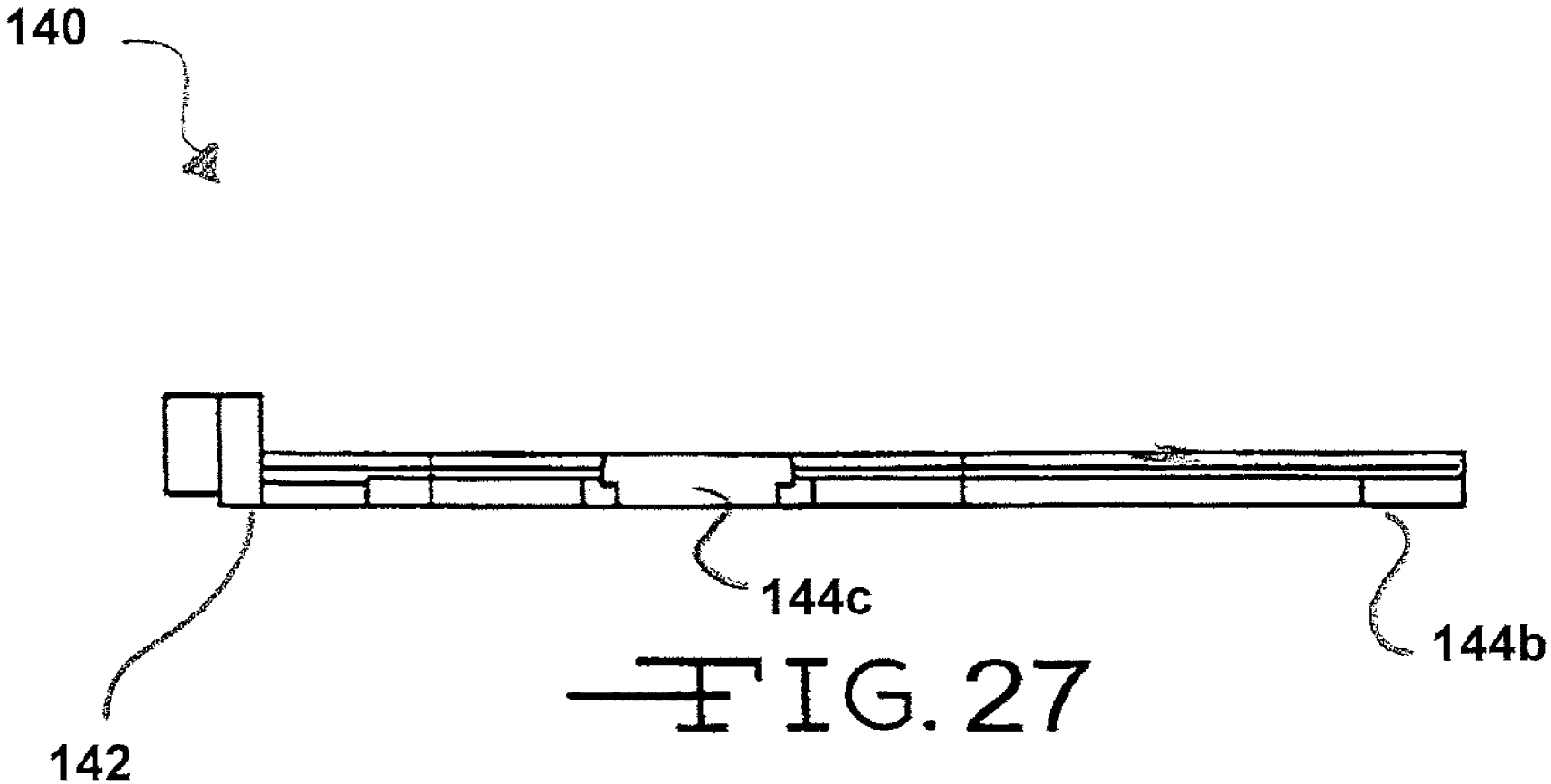
FIG. 27 depicts a side elevational view of the bottom cover of FIG. 24.
Figure 28:
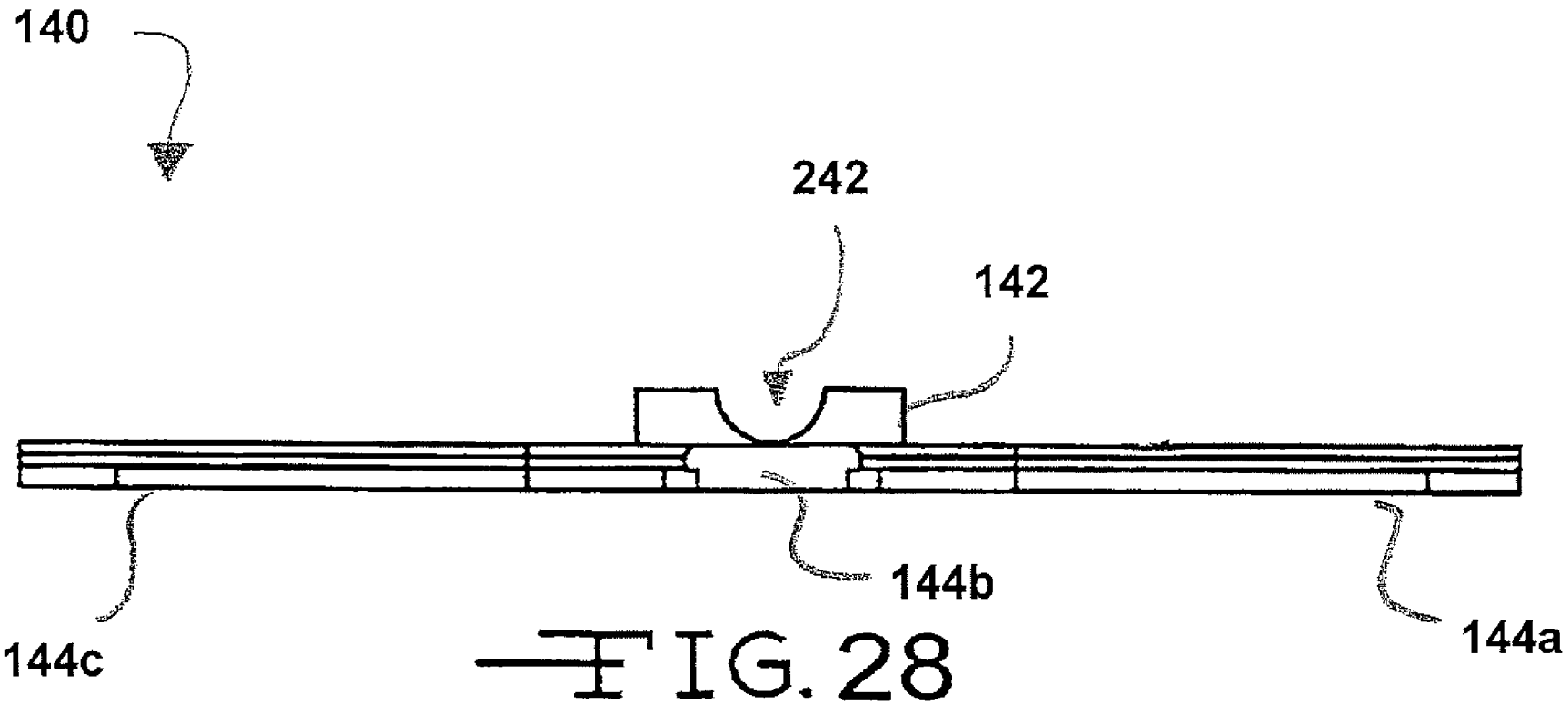
FIG. 28 depicts a rear elevational view of the bottom cover of FIG. 24.

In the illustrated version, common electrode assembly 160 is positioned between the lower surface 129*b* of upper cover 120 and the upper surface 139*a* of lower cover 130. Common electrode assembly 160 may comprise brass, flat fabricated brass or copper busbars, braided copper strands, or any other material suitable for the intended application(s) of a particular embodiment. As shown in FIGS. 2 and 10, common electrode assembly 160 comprises common spade connector 16 and a plurality of common spade electrodes 162*a*, 162*b*, 162*c*. Each common spade electrode 162*a*, 162*b*, 162*c* may be configured to receive and engage a common spade connector of a male electrical plug (not shown) inserted into a female output connector 12*a*, 12*b*, 12*c* of wall tap 10. In this version, common electrode assembly 160 is shaped and configured to correspond to the other components of subassembly 100. As with the other components, other suitable numbers and arrangements of electrodes and connectors may be used.

In the embodiment shown in FIG. 2, ground electrode assembly 150 is positioned between the lower surface 139*b* of lower cover 130 and bottom cover 140. Ground electrode assembly 150 may comprise brass, flat fabricated brass or copper busbars, braided copper strands, or any other material suitable for the intended application(s) of a particular embodiment. As shown in FIGS. 2 and 21-23, ground electrode assembly 150 comprises grounding pin 18 and a plurality of pin electrodes 152*a*, 152*b*, 152*c*. Each pin electrode 152*a*, 152*b*, 152*c* may be configured to receive and engage a grounding pin of a male electrical plug (not shown) inserted into a female output connector 12*a*, 12*b*, 12*c* of wall tap 10. In this version, ground electrode assembly 150 is shaped and configured to correspond to the other components of subassembly 100. As with the other components, other suitable numbers and arrangements of electrodes and pins may be used.

In the illustrated embodiment, top cover 110 comprises a central portion 111, a male input connector member 112, and a plurality of female output connector members 114*a*, 114*b*, 114*c*. Of course, the number and arrangement of the female output connector members and the male input connector member may be varied depending on the intended application(s) for a particular embodiment. As shown, central portion 111 includes a lamp opening 117. Lamp opening may be configured to be aligned with lamp 126 once subassembly 100 is fully assembled. Lens 15 may be configured to be attached to lamp opening to shield lamp 126. Lens 15 may be transparent or translucent and made of any suitable material, including but not limited to glass, plastic, and plexiglass. Lens 15 may be configured to allow light from lamp 126 to emanate from the top cover 110 when top cover 110 is assembled with upper cover 120. Male input connector member 112 may be configured to cover at least portion of male input connector portion 122 of upper cover 120 when top cover 110 is assembled together with upper cover 120. Similarly, female output connector portions 114*a*, 114*b*, 114*c* may be configured to cover at least a portion of female output connector portions 124*a*, 124*b*, 124*c* of upper cover 120 when top cover 110 is assembled together with upper cover 120.

As shown in FIGS. 2-7, each female output connector portion 114*a*, 114*b*, 114*c* comprises an attachment aperture 116*a*, 116*b*, 116*c*. Each attachment aperture 116*a*, 116*b*, 116*c* further comprises a lip 118*a*, 118*b*, 118*c*. As described in more detail below, each attachment aperture 116*a*, 116*b*, 116*c* is configured to receive an attachment member 137*a*, 137*b*, 137*c* extending from lower cover 130. Each attachment member 137*a*, 137*b*, 137*c* comprises a tab 237*a*, 237*b*, 237*c* that is configured to engage a respective lip 118*a*, 118*b*, 118*c* of each attachment aperture 116*a*, 116*b*, 116*c*, Lips 118*a*, 118*b*, 118*c* may be configured to fixedly or releasably engage tabs 237*a*, 237*b*, 237*c*. In the illustrated version, male input connector portion 112 comprises an engagement member 113. Engagement member 113 may be configured to engage an upper notch 224*a* in upper cover 120 when top cover 110 and upper cover 120 are assembled. Upper notch 224*a* may be configured to fixedly or releasably engage engagement member 113.

As shown in FIGS. 2 and 11-15, upper cover 120 comprises a central portion 121, a male input connector portion 122 and a plurality of female output connector portions 124*a*, 124*b*, 124*c*. In the illustrated version, central portion 121 comprises a lamp 126. Lamp 126 may comprise a light source in communication with a light socket. The light source may include but is not limited to an incandescent bulb, a halogen bulb, a fluorescent bulb, a compact fluorescent lamp, a CFL high-intensity discharge lamp, a HID, low-pressure sodium lamp, a light emitting diode, or any other suitable light source. Lamp 126 may be in electrical communication with male input connector 13 such that lamp 126 is illuminated when male input connector 13 is plugged into an electrical outlet and wall tap 10 is electrically energized. Alternatively, lamp 126 may be in electrical communication with both male input connector and at least one female output connector 12*a*, 12*b*, 12*c*, such that lamp 126 is illuminated when male input connector 13 is plugged into an electrical outlet and a male plug is inserted into the at least one female output connector 12*a*, 12*b*, 12*c*.

In the illustrated embodiment, each female connector portion 124*a*, 124*b*, 124*c* comprises an attachment channel 127*a*, 127*b*, 127*c*. In this example, each attachment channel 127*a*, 127*b*, 127*c* extends through upper cover 120 and is oriented to align with a respective one of attachment apertures 116*a*, 116*b*, 116*c*, when subassembly 100 is fully assembled. As shown, each attachment channel 127*a*, 127*b*, 127*c* is configured to receive at least a portion of an attachment member 137*a*, 137*b*, 137*c* extending from lower cover 130 when subassembly 100 is fully assembled.

In this version, each female connector portion 124*a*, 124*b*, 124*c* further comprises a first exterior opening 123*a*, 123*b*, 123*c*. Each first exterior opening 123*a*, 123*b*, 123*c* is in communication with an upper cavity 223*a*, 223*b*, 223*c* in upper surface 129*a* of upper cover 120. As shown in FIGS. 2 and 11-15, each upper cavity 223*a*, 223*b*, 223*c* is configured to receive a respective one of the active spade electrodes 172*a*, 172*b*, 172*c*. Each first exterior opening 123*a*, 123*b*, 123*c* is configured to provide access to a corresponding active spade electrode 172*a*, 172*b*, 172*c* when subassembly 100 is fully assembled.

In the illustrated version, each female connector portion 124*a*, 124*b*, 124*c* further comprises a second exterior opening 125*a*, 125*b*, 125*c*. Each second exterior opening 125*a*, 125*b*, 125*c* is in communication with a lower cavity 225*a*, 225*b*, 225*c* in lower surface 129*b* of upper cover 120. As shown, each lower cavity 225*a*, 225*b*, 225*c* is configured to receive a respective one of the common spade electrodes 162*a*, 162*b*, 162*c*. Each second exterior opening 125*a*, 125*b*, 125*c* is configured to provide access to a corresponding common spade electrode 162*a*, 162*b*, 162*c* when subassembly 100 is fully assembled.

As shown in FIGS. 2 and 11-15, male connector portion 122 comprises an upper cavity 222*a* and a lower cavity 222*b*. In this example upper cavity 222*a* is disposed on upper surface 129*a* of upper cover 120, and lower cavity 222*b* is disposed on lower surface 129*b* of upper cover 120. As shown, upper cavity 222*a* is configured to receive at least a portion of active electrical spade connector 14 when subassembly 100 is fully assembled. In this version, lower cavity 222*b* is configured to receive at least a portion of common electrical spade connector 16 when subassembly 100 is fully assembled. Male connector portion further comprises upper notch 224*a* which is configured to receive and engage engagement member 113 of top cover 110.

As shown in FIGS. 2 and 16-20, lower cover 130 comprises a central portion 131, a male input connector portion 132 and a plurality of female output connector portions 134*a*, 134*b*, 134*c*. Male input connector member 132 may be configured to correspond with male input connector portion 122 of upper cover 120. Similarly, female output connector portions 134*a*, 134*b*, 134*c* may be configured to correspond with female output connector portions 124*a*, 124*b*, 124*c* of upper cover 120.

In the illustrated embodiment, each female connector portion 134*a*, 134*b*, 134*c* comprises an attachment member 137*a*, 137*b*, 137*c*. As shown, each attachment member 137*a*, 137*b*, 137*c* comprises a tab 237*a*, 237*b*, 237*c* that is configured to engage a respective lip 118*a*, 118*b*, 118*c* of each attachment aperture 116*a*, 116*b*, 116*c* in top cover 110. In this example, each attachment member 137*a*, 137*b*, 137*c* extends substantially perpendicularly from upper surface 139*a* of lower cover 130. In this version, each attachment member 137*a*, 137*b*, 137*c* is configured to extend through an attachment channel 127*a*, 127*b*, 127*c* in upper cover 120 and an attachment aperture 116*a*, 116*b*, 116*c* in top cover 110 when subassembly 100 is fully assembled. As described above, upon assembly of subassembly 100, each tab 237*a*, 237*b*, 237*c* is configured to engage a lip 118*a*, 118*b*, 118*c* in each attachment aperture 116*a*, 116*b*, 116*c*. Of course, other suitable methods and structures for fixedly or releasably engaging attachment members 137*a*, 137*b*, 137*c* and top cover 110 will be apparent to those of ordinary skill in the art.

As shown in FIGS. 2 and 16-20, lower cover 130 further comprises an engagement member 133. Engagement member 133 may be configured to engage a lower notch 224*b* in upper cover 120 when lower cover 130 and upper cover 120 are assembled. Lower notch 224*b* may be configured to fixedly or releasably engage engagement member 133.

In the illustrated embodiment, each female connector portion 134*a*, 134*b*, 134*c* further comprises an exterior opening 135*a*, 135*b*, 135*c*. Each exterior opening 135*a*, 135*b*, 135*c* is in communication with an interior cavity 235*a*, 235*b*, 235*c* in lower surface 139*b* of lower cover 130. As shown, each interior cavity 235*a*, 235*b*, 235*c* is configured to receive a respective one of the pin electrodes 152*a*, 152*b*, 152*c*. Each exterior opening 135*a*, 135*b*, 135*c* is configured to provide access to a corresponding pin electrode 152*a*, 152*b*, 152*c* when subassembly 100 is fully assembled.

In this example, male connector portion 132 comprises an upper opening 232. As shown, upper opening 232 is in communication with lower surface 139*b* of lower cover 130. Upper opening 232 may be configured to receive at least a portion of grounding pin 18. In the illustrated version, upper opening 232 is semi-circular. Of course, upper opening 232 may comprise any shape and size suitable to receive at least a portion of a grounding pin. The size and shape of upper opening 232 may correspond with the size and shape of lower opening 242, although this is not required. Upper opening 232 may be further configured to be aligned with lower opening 242 in bottom cover 140 when lower cover 130 and bottom cover 140 are assembled.

As shown in FIGS. 2 and 24-28, bottom cover 140 comprises a central portion 141, a male input connector portion 142 and a plurality of female output connector portions 144*a*, 144*b*, 144*c*. Male input connector member 142 may be configured to correspond with male input connector portion 132 of lower cover 130. Similarly, female output connector portions 144*a*, 144*b*, 144*c* may be configured to correspond with female output connector portions 134*a*, 134*b*, 134*c* of lower cover 130.

In the illustrated embodiment, each female connector portion 144*a*, 144*b*, 144*c* is configured to enclose a respective in electrode 152*a*, 152*b*, 152*c* within an interior cavity 235*a*, 235*b*, 235*c* of lower cover 130 when lower cover 130 and bottom cover 140 are assembled. As shown, male connector portion 142 comprises lower opening 242. As shown, lower opening 242 is in communication with upper surface 149*a* of bottom cover 140. Lower opening 242 may be configured to receive at least a portion of grounding pin 18. In the illustrated version, lower opening 242 is semi-circular. Of course, lower opening 242 may comprise any shape and size suitable to receive at least a portion of a grounding pin. The size and shape of lower opening 242 may correspond with the size and shape of upper opening 232, although this is not required. Lower opening 242 may be further configured to be aligned with upper opening 232 in lower cover 130 when lower cover 130 and bottom cover 140 are assembled.

Once subassembly 100 is fully assembled, it may be encapsulated within a one piece molded, elastomeric covering as illustrated in FIG. 1. In alternate embodiments, the covering may comprise more than one piece. In addition, any suitable material may be used for the covering.

Collectively, in the illustrated embodiment, pin electrode 152*a*, common spade electrode 162*a*, and active spade electrode 172*a* form female output connector 12*a*. In this version, pin electrode 152*b*, common spade electrode 162*b*, and active spade electrode 172*b* collectively form female output connector 12*b*. Similarly, as shown, pin electrode 152*c*, common spade electrode 162*c*, and active spade electrode 172*c* collectively form female output connector 12*c*. In the illustrated example, grounding pin 18, active electrical spade connector 14, and common electrical spade connector 16 collectively form male input connector 13.

As shown in FIG. 2, electrical subassembly 100 may be assembled in the following manner. Electrical subassembly 100 may be configured to provide a snap-fit engagement between two or more of its components. The components of electrical subassembly 100 may be releasably or fixedly engaged with one another. In addition, some components may be fixedly engaged with each other, while other components are releasably engaged with each other. Of course, other suitable arrangements and manners of assembly and engagement will be apparent to those skilled in the art.

In the illustrated embodiment, active electrode assembly 170 is positioned between top cover 110 and upper surface 129*a* of upper cover 120. In this version, at least a portion of active electrical spade connector 14 is positioned within upper cavity 222*a* of upper cover 120. In addition, active spade electrodes 172*a*, 172*b*, 172*c* are positioned within a corresponding one of upper cavities 223*a*, 223*b*, 223*c*. In this version, top cover 110 is then engaged with upper cover 120 such that engagement member 113 engages upper notch 224*a*, and attachment apertures 116*a*, 116*b*, 116*c* are aligned with attachment channels 127*a*, 127*b*, 127*c*. Top cover 110 may also be positioned such that lamp opening 117 is aligned with lamp 126. Top cover 110 and upper cover 120 may provide additional points of engagement depending on the intended application(s) of wall tap 10.

In the embodiment shown in FIG. 2, common electrode assembly 160 is positioned between lower surface 129*b* of upper cover 120 and upper surface 139*a* of lower cover 130. In this version, at least a portion of common electrical spade connector 16 is positioned within lower cavity 222*b* of upper cover 120. In addition, common spade electrodes 162*a*, 162*b*, 162*c* are positioned within a corresponding one of lower cavities 225*a*, 225*b*, 225*c*. In this version, lower cover 130 is then engaged with upper cover 120 such that engagement member 133 engages lower notch 224*b*, and each attachment member 137*a*, 137*b*, 137*c* is inserted through a corresponding one of attachment channels 127*a*, 127*b*, 127*c* such that each tab 237*a*, 237*b*, 237*c* engages the lip 118*a*, 118*b*, 118*c* of a corresponding attachment aperture 116*a*, 116*b*, 116*c* in top cover 110. Upper cover 120 and lower cover 130 may provide additional points of engagement depending on the intended application(s) of wall tap 10.

In the illustrated embodiment, ground electrode assembly 150 is positioned between lower surface 139*b* of lower cover 130 and bottom cover 140. In this version, at least a portion of grounding pin 18 is positioned between upper opening 232 of lower cover 130 and lower opening 242 of bottom cover 140. In addition, pin electrodes 152*a*, 152*b*, 152*c* are positioned within a corresponding one of interior cavities 235*a*, 235*b*, 235*c*. In this version, bottom cover 140 is then engaged with lower cover 130. Lower cover 130 and bottom cover 140 may provide one or more points of engagement depending on the intended application(s) of wall tap 10.

It is to be understood that "first" and "second" and "top" and "bottom" and "upper" and "lower" as used in the present application are arbitrary, inasmuch as the present invention can be oriented in different directions. Therefore, "first" and "second" and "top" and "bottom" and "upper" and "lower" should be understood to be used with reference to the orientation of the invention as shown in the drawings herein, and are not limiting with regard to the orientation of the invention in actual use.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. An electrical wall tap assembly comprising:

(a) a central portion;

(b) a male input connector, wherein the male input connector is adjacent to the central portion, wherein the position of the male input connector is configured to be fixed in relation to the central portion;

(c) at least one female output connector, wherein the at least one female output connector is adjacent to the central portion; and (d) an electrical subassembly, wherein the electrical subassembly comprises a top cover, wherein the top cover comprises at least one attachment aperture, (ii) an upper cover, (iii) a lower cover, wherein the lower cover comprises at least one attachment member, wherein the attachment member is configured to engage the at least one attachment aperture in the top cover, (iv) a bottom cover, and (v) an electric power distribution circuitry positioned among the top cover, the upper cover, the lower cover, and the bottom cover, wherein the electric power distribution circuitry is configured to electrically connect the male input connector to the at least one female output connector.

2. The electrical wall tap assembly of claim 1, wherein the upper cover is positioned between the top cover and the lower cover.

3. The electrical wall tap assembly of claim 2, wherein the upper cover comprises at least one engagement channel, wherein the at least one engagement channel is configured to receive at least a portion of the at least one attachment member of the lower cover.

4. The electrical wall tap assembly of claim 1, wherein the electrical subassembly further comprises a lamp.

5. The electrical wall tap assembly of claim 4, wherein the lamp is electrically connected to the male input connector such that the lamp illuminates when the male input connector is inserted into an electrical outlet.

6. The electrical wall tap assembly of claim 1, wherein the electric power distribution circuitry comprises:

(a) an active electrode assembly;

(b) a common electrode assembly; and (c) a ground electrode assembly.

7. The electrical wall tap assembly of claim 6, wherein the active electrode assembly is positioned between the top cover and the upper cover, wherein the common electrode assembly is positioned between the upper cover and the lower cover, wherein the ground electrode assembly is positioned between the lower cover and the bottom cover.

8. An electrical wall tap assembly comprising:

(a) an electrical subassembly, wherein the electrical subassembly comprises:

(i) a top cover, wherein the top cover comprises at least one attachment aperture, wherein the top cover is shaped to have a generally cross-like shape, (ii) an upper cover, (iii) a lower cover, wherein the lower cover comprises at least one attachment member, wherein the attachment member is configured to engage the at least one attachment aperture in the top cover, (iv) a bottom cover, wherein the bottom cover is shaped to have a generally cross-like shape such that the cross-like shape of the top cover and the cross-like shape of the bottom cover facilitates the electrical subassembly to receive a plurality of male plug, and (v) an electric power distribution circuitry positioned among the top cover, the upper cover, the lower cover, and the bottom cover; and (b) an outer covering, wherein the outer covering encases the electrical subassembly.

9. The electrical wall tap assembly of claim 8, wherein the outer covering comprises a one-piece, molded covering.

10. The electrical wall tap assembly of claim 8, wherein the outer covering comprises an elastomeric material.

11. The electrical wall tap assembly of claim 8, wherein the electric power distribution circuitry comprises:

(a) an active electrode assembly, wherein the active electrode assembly comprises a plurality of active spade electrodes;

(b) a common electrode assembly, wherein the common electrode assembly comprises a plurality of common spade electrodes; and (c) a ground electrode assembly, wherein the ground electrode assembly comprises a plurality of pin electrodes.

12. The electrical wall tap assembly of claim 11, wherein the upper cover comprises a plurality of upper cavities, wherein each of the plurality of upper cavities is configured to receive a corresponding one of the active spade electrodes, wherein the upper cover further comprises a plurality of lower cavities, wherein each of the plurality of lower cavities is configured to receive a corresponding one of the common spade electrodes.

13. The electrical wall tap assembly of claim 12, wherein the each of the plurality of upper cavities are disposed on an upper surface of the upper cover, wherein each of the plurality of lower cavities are disposed on a lower surface of the upper cover.

14. The electrical wall tap assembly of claim 11, wherein the upper cover comprises a lamp, wherein the top cover further comprises a lamp opening aligned with the lamp, wherein the outer covering further comprises a lens embedded within the outer covering and aligned with the lamp and the lamp opening.

15. An electrical wall tap assembly comprising:

(a) a male input connector;

(b) a plurality of female output connectors, wherein each of the plurality of female output connectors is electrically connected to the male input connector, wherein each of the plurality of female output connectors is structurally connected to the male input connector such that each of the plurality of female output connectors maintains a constant position in relation to the male input connector, wherein at least two of the plurality of female output connectors are positioned to be symmetrically opposed to one another; and (c) an electrical subassembly, wherein the electrical subassembly comprises:

(i) a top cover, wherein the top cover comprises a plurality of female connector portions, wherein each of the plurality of female connector portions of the top cover comprises an attachment aperture, (ii) an upper cover, (iii) a lower cover, wherein the lower cover comprises a plurality of female connector portions, wherein each of the plurality of female connector portions of the lower cover comprises an attachment member, wherein each attachment member is configured to engage a respective attachment aperture in one of the plurality of female connector portions of the top cover, (iv) a bottom cover, and (v) an electric power distribution circuitry positioned among the top cover, the upper cover, the lower cover, and the bottom cover, wherein the electric power distribution circuitry is configured to electrically connect the male input connector to each of the plurality of female output connectors.

16. The electrical wall tap assembly of claim 15 further comprising an outer covering, wherein the outer covering encases the electrical subassembly.

17. The electrical wall tap assembly of claim 15, wherein the upper cover further comprises a plurality of female connector portions, wherein each of the plurality of female connector portions of the upper cover comprises an attachment channel, wherein each attachment channel is configured to receive at least a portion of a corresponding one of the plurality of attachment members.

18. The electrical wall tap assembly of claim 15, wherein each attachment aperture further comprises a lip configured to engage a corresponding one of the plurality of attachment members.

19. The electrical wall tap assembly of claim 18, wherein each attachment member comprises a tab on a free end, wherein the tab is configured to engage the lip of a corresponding one of the plurality of attachment aperture.

20. The electrical wall tap assembly of claim 15, wherein each attachment aperture is configured to releasably engage a corresponding one of the plurality of attachment members.

* * * * *